US007330166B2

(12) United States Patent
Marcotte

(10) Patent No.: US 7,330,166 B2
(45) Date of Patent: Feb. 12, 2008

(54) PLASMA DISPLAY WITH SPLIT ELECTRODES

(75) Inventor: Robert G. Marcotte, New Paltz, NY (US)

(73) Assignee: Matsushita Electronic Industrial Co., Ltd, Osaka (JP)

( * ) Notice: Subject to any disclaimer, the term of this patent is extended or adjusted under 35 U.S.C. 154(b) by 583 days.

(21) Appl. No.: 10/849,647

(22) Filed: May 19, 2004

(65) Prior Publication Data

US 2004/0212566 A1 Oct. 28, 2004

Related U.S. Application Data

(63) Continuation-in-part of application No. 10/458,402, filed on Jun. 10, 2003, now Pat. No. 6,853,144.

(60) Provisional application No. 60/392,518, filed on Jun. 28, 2002.

(51) Int. Cl.
*G09G 3/28* (2006.01)

(52) U.S. Cl. ..... 345/63; 345/67; 315/169.4

(58) Field of Classification Search ..... 345/68, 345/67, 58, 41, 63; 315/169.4, 169.1; 324/92; 313/585

See application file for complete search history.

(56) References Cited

U.S. PATENT DOCUMENTS

| | | | | |
|---|---|---|---|---|
| 4,772,884 | A | 9/1988 | Weber et al. | 340/776 |
| 4,812,017 | A | 3/1989 | Piper | 350/333 |
| 5,852,347 | A | 12/1998 | Marcotte | 315/169.4 |
| 5,998,935 | A | 12/1999 | Marcotte | 315/169.4 |
| 6,054,970 | A | 4/2000 | Hirakawa et al. | 345/60 |
| 6,118,214 | A | 9/2000 | Marcotte | 313/582 |
| 6,184,848 | B1 | 2/2001 | Weber | 345/60 |
| 6,411,035 | B1 * | 6/2002 | Marcotte | 313/585 |
| 6,611,099 | B1 | 8/2003 | Murata et al. | 313/582 |
| 6,628,075 | B1 | 9/2003 | Kim | 313/586 |
| 6,853,144 | B2 * | 2/2005 | Marcotte | 315/169.1 |
| 2002/0030645 | A1 * | 3/2002 | Lee et al. | 345/68 |

* cited by examiner

*Primary Examiner*—Amr A. Awad
*Assistant Examiner*—Yong Sim
(74) *Attorney, Agent, or Firm*—Ohlandt, Greeley, Ruggiero & Perle, L.L.P.

(57) ABSTRACT

A method of controlling electrodes of a pixel in a plasma display panel. The method includes applying a first voltage to a first electrode of the pixel during a sustain discharge involving the first electrode, and applying a second voltage to a second electrode of the pixel. The first voltage and the second voltage have a relationship that encourages the sustain discharge to extend to the second electrode.

29 Claims, 16 Drawing Sheets

500

PLASMA DISPLAY WITH SPLIT ELECTRODES

CROSS REFERENCE TO RELATED APPLICATIONS

The present application is a continuation-in-part of U.S. application Ser. No. 10/458,402, filed on Jun. 10, 2003, now U.S. Pat. No. 6,853,144 which claims priority of U.S. Provisional Patent Application Ser. No. 60/392,518, filed on Jun. 28, 2002, the contents of both of which are herein incorporated by reference.

BACKGROUND OF THE INVENTION

1. Field of the Invention

The present invention relates to plasma display panels, and more particularly, to a pixel architecture that controls discharge area to minimize addressing power and vertical crosstalk between pixels and that enhances sustain discharge of the pixels by controlling discharge area as a means to control power and brightness.

2. Description of the Related Art

Color plasma display panels (PDPs) are well known in the art. Visible light is emitted by phosphors within the panel in response to gas plasma discharges between a pixel's sustain and scan electrode. During an addressing period, sustain electrodes are generally driven with a common potential, while scan electrodes are selected individually. Since the electrodes are on an internal surface of a front plate, the light produced must pass through the electrodes. When transparent electrodes, e.g., indium tin oxide (ITO), are employed, the light simply passes through the electrode. Alternatively, non-transparent apertured electrodes may be devised that allow the light to pass through open apertures in the electrode.

An embodiment of an AC color PDP is disclosed in U.S. Pat. No. 6,118,214 to Marcotte (hereinafter "the '214 patent) in which apertured electrodes are employed on a front plate. More particularly, the AC PDP includes horizontal pairs of apertured sustain electrodes that connect to a sustain bus. Pairs of independent scan apertured electrodes, are interdigitated with the pairs of common sustain electrodes. The apertured electrodes are generally produced using opaque metallic electrode materials such as silver or a film stack of chrome-copper-chrome.

Contrast enhancement bars are horizontally situated in inter-pixel gaps between horizontally adjacent pixels to reduce the light reflectivity of the phosphor. The contrast enhancement bars are opaque and may be conductive or non-conductive. For additional description of contrast enhancement bars, see U.S. Pat. No. 5,998,935 to Marcotte.

During processing, the electrodes are covered by a dielectric layer and a magnesium oxide (MgO) layer. A back plate supports vertical barrier ribs and plural vertical column conductors. The individual column conductors are covered with red, green, or blue phosphors, as the case may be, to enable a full color display to be achieved. The front and rear plates are sealed together and a space there between is filled with a dischargeable gas.

A pixel is a region at an intersection of electrodes. For example, a pixel is defined at an intersection of a sustain electrode and an adjacent scan electrode on the front plate and three back plate column electrodes for red, green, and blue. A sub-pixel, or sub-pixel site, refers to an intersection of individual red, green, and blue column electrodes with the front plate scan/sustain electrode pair.

The PDP operating voltage and power are controlled by the space between adjacent sustain and scan electrodes (hereinafter referred to as a sustain gap), the width of the lines making up the apertured electrodes, and the overall width of electrodes. The sustain and scan electrodes are generally placed to provide a relatively narrow sustain gap and a relatively wide inter-pixel gap.

Alternating sustaining discharges form at the sustain gap, and spread out vertically. The discharge forms a positive column region branching a positively charged anode electrode and a negative glow region drifts across a negatively charged cathode electrode. In the case of apertured electrodes, the line widths and spacing are balanced to maximize light transmission and to maximize discharge voltage uniformity. For example, minimizing the line width to 40-60 microns and spacing the horizontal lines at a distance less than or near the sustain gap dimension (e.g., 100 microns) achieves this balance. In the paired electrode configuration the electrodes on each side of the inter-pixel gap are at the same potential, therefore the inter-pixel gap must be made sufficiently large to prevent plasma discharges from spreading and corrupting an ON or OFF state of an adjacent pixel.

The overall width of the apertured electrodes, the line widths, the line spaces and the dielectric glass thickness over the electrode combine to determine the pixel's discharge capacitance, which controls the discharge power and therefore brightness. For a given discharge power and therefore brightness of each discharge, a number of discharges in a predetermined period of time is chosen to meet an overall brightness requirement for the panel.

The paired front plate electrode configuration has the advantage of reduced inter-electrode capacitance, which reduces power dissipation resulting from charging and discharging of the inter-electrode capacitance of each sustain pulse. However, there is a possibility of vertical crosstalk resulting from the electrodes on either side of the inter-pixel gap being driven with the same potential. Vertical crosstalk occurs when a discharge at one discharge site spreads into a vertically adjacent discharge site, i.e., for an adjacent pixel, and affects the ON or OFF state of the adjacent pixel. The '214 patent utilizes a relatively large inter-pixel gap to help increase the vertical pixel to pixel isolation. Note that the back plate barrier ribs provide horizontal pixel isolation but no vertical isolation.

The greatest probability of vertical crosstalk occurs during the addressing period when each row is sequentially addressed to place desired sub-pixels in the ON state. In an addressing discharge, the plasma discharge forms between a selected scan electrode and a data electrode and the discharge's positive column spreads along the back plate data electrode to the sustain electrode. With an adjacent electrode at the same potential, the positive column can cross the inter-pixel gap and deplete the charge on an adjacent sub-pixel's sustain electrode. The presence of the contrast enhancement bar has been shown to have little effect on this address crosstalk mechanism.

SUMMARY OF THE INVENTION

The present invention provides a method and a pixel architecture for plasma display panels. Electrodes of the pixels are controlled to enhance operation of the pixels and to provide a method for controlling power and brightness.

A method embodiment of the present invention controls a discharge in a pixel by providing an electrode topology that is disposed with respect to the pixel to define a first area and a second area of the pixel, the first area being larger than the second area. The brightness of the discharge is controlled by selectively causing the discharge to occur in the first and second areas.

Another embodiment of the method of the present invention additionally controls the brightness by modulating at least one of the voltages in amplitude and/or duration.

In another embodiment of the method, the second area may be centered within the first area of the pixel.

In another embodiment of the method, the discharge may take place in a set up period, an address period or a sustain period.

In another embodiment of the method, the step of controlling controls brightness of the pixel.

In another embodiment of the method, a first sustain period of a first sub-field discharges the second area and a second sustain period of a second sub-field discharges the first area.

In another method embodiment of the present invention, there is applied a first voltage waveform to a first electrode of the pixel, a second voltage waveform to a second electrode of the pixel and a third voltage waveform to a third electrode of the pixel. The first voltage waveform, the second voltage waveform and the third voltage waveform have a relationship that during a sustain period encourages a sustain discharge to extend from the first electrode to the second and third electrodes.

In another embodiment of the method, during at least one sustain cycle of the sustain period, the second voltage waveform has a magnitude that is greater than a magnitude of the first waveform and less than a magnitude of the third waveform.

In another embodiment of the method, the first, second and third electrodes are selected from the group consisting of: sustain and scan. In a more specific embodiment, the first, second and third electrodes are selected from the group consisting of: (a) inner sustain electrode, middle sustain electrode and outer sustain electrode and (b) inner scan electrode, middle scan electrode and outer scan electrode.

In another embodiment of the method, during a set up period and an addressing period the second and third waveforms are substantially identical.

In another embodiment of the method, the first, second and third voltage waveforms are applied independently of one another.

In another embodiment of the method, the first electrode is narrower than the second electrode, which is narrower than the third electrode.

In another embodiment of the method, the sustain discharge involves the first electrode.

In another method embodiment of the present invention there is provided the additional steps of applying a first voltage waveform to an outer sustain electrode of the pixel, a second voltage waveform to a middle sustain electrode of the pixel, a third voltage waveform to an inner sustain electrode of the pixel, a fourth voltage waveform to an inner scan electrode of the pixel, a fifth voltage waveform to a middle scan electrode of the pixel and a sixth voltage waveform to an outer scan electrode of the pixel. The first, second, third, fourth, fifth and sixth voltage waveforms have relationships that (i) discourage an addressing discharge involving the inner sustain electrode and the inner scan electrode from extending to the middle and outer sustain electrodes and to the middle and outer scan electrodes, and (ii) permit a sustaining discharge involving the inner sustain electrode and the inner scan electrode to extend to the middle and outer sustain electrodes and the middle and outer scan electrodes.

In another embodiment of the method, the discharge is discouraged from extending to the first area.

A plasma display panel embodiment of the present invention includes a pixel and an electrode topology that is disposed with respect to the pixel to define a first area and a second area of the pixel, the first area being larger than the second area. A controller applies voltages to the electrode topology to control a brightness of a discharge of the pixel by selectively causing the discharge to occur in the first and second areas.

In another embodiment of the plasma display panel of the present invention, the second area is centered in the first area.

In another embodiment of the plasma display panel, the electrode topology comprises at least four electrodes, of which two define the second area and all of which define the first area.

In another embodiment of the plasma display panel, the discharge may take place in the setup period, address period or sustain period.

In another embodiment of the plasma display panel, the voltages modulate the discharge, thereby controlling the brightness of the pixel.

In another embodiment of the plasma display panel, a first sustain period of a first sub-field the discharge occurs in the second area and in a second sustain period of a second sub-field the discharge occurs in the first area.

In another embodiment of the plasma display panel, electrode topology comprises at least one split electrode set that comprises more than two electrodes.

In another embodiment of the plasma display panel, the discharge of the pixel is limited to the second area.

In another embodiment of the plasma display panel, the electrode topology further defines a third area of the pixel that is within the first area, wherein the second area is within the third area, and wherein the voltages initiate a discharge during a sustain period that spreads to the third area, but not to the first area, thereby confining a light output to the second and third areas of the pixel.

In another embodiment of the plasma display panel, the electrode topology comprises an outer sustain electrode, a middle sustain electrode, an inner sustain electrode, an inner scan electrode, a middle scan electrode and an outer scan electrode.

In another embodiment of the plasma display panel, the controller applies first, second, third, fourth, fifth and sixth voltages to the outer sustain, the middle sustain, the inner sustain, the inner scan, the middle scan and the outer scan electrodes, respectively. During a first cycle of the sustain period, a magnitude of the fifth voltage is greater than a magnitude of the fourth voltage and a magnitude of the sixth voltage. The first, second and third voltages each have a magnitude that is less than the magnitudes of the fourth and sixth voltages.

In another embodiment of the plasma display panel, during a second cycle of the sustain period, a magnitude of the second voltage is greater than a magnitude of the first voltage and a magnitude of the third voltage and the fourth, fifth and sixth voltages each have a magnitude that is less than the magnitudes of the first and third voltages.

In another embodiment of the plasma display panel, the electrode topology comprises a first electrode, a second electrode and a third electrode arranged to control discharge of plasma gas at the pixel. The controller applies a first voltage waveform, a second voltage waveform and a third voltage waveform to the first, second and third electrodes, respectively. The first, second and third voltage waveforms have a relationship that during a sustain period encourages a sustain discharge to extend from the first electrode to the second and third electrodes.

In another embodiment of the plasma display panel, during at least one sustain cycle of the sustain period the second voltage waveform has a magnitude that is greater than a magnitude of the first waveform and less than a magnitude of the third waveform.

In another embodiment of the plasma display panel, the first, second and third electrodes are selected from the group consisting of: sustain and scan.

In another embodiment of the plasma display panel, the first, second and third electrodes are selected from the group consisting of: (a) inner sustain electrode, middle sustain electrode and outer sustain electrode and (b) inner scan electrode, middle scan electrode and outer scan electrode.

In another embodiment of the plasma display panel, during a set up period and an addressing period the second and third waveforms are substantially identical.

In another embodiment of the plasma display panel, the first electrode is narrower than the second electrode and the second electrode is narrower than the third electrode.

In another embodiment of the plasma display panel, the first, second and third waveforms are applied independently of one another.

In another embodiment of the plasma display panel, the third electrode is configured as a loop and also serves as an electrode for an adjacent pixel.

In another embodiment of the plasma display panel, the second electrode is located between the first and third electrodes.

In another embodiment of the plasma display panel, at least one of the first and second electrodes is an apertured electrode.

In another embodiment of the plasma display panel, at least one of the first, second and third electrodes includes an electrically conductive transparent region.

In another embodiment of the plasma display panel, the electrode topology comprises a plurality of electrodes arranged to control a discharge of plasma gas at the pixel, the plurality of electrodes including an inner scan electrode, a middle scan electrode, an outer scan electrode, an inner sustain electrode, a middle sustain electrode and an outer sustain electrode; and wherein the controller applies a first voltage waveform, a second voltage waveform, a third voltage waveform, a fourth voltage waveform, a fifth voltage waveform and a sixth voltage waveform to the inner scan electrode, the middle scan electrode, the outer scan electrode, the inner sustain electrode, the middle sustain electrode and the outer sustain electrode, respectively. The first, second, third, fourth, fifth and sixth voltage waveforms have a relationship that (i) discourage an addressing discharge involving the inner sustain electrode and the inner scan electrode from extending to the middle and outer sustain electrodes and to the middle and outer scan electrodes, and (ii) permit a sustaining discharge involving the inner sustain electrode and the inner scan electrode to extend to the middle and outer sustain electrodes and the middle and outer scan electrodes.

In another embodiment of the plasma display panel, the inner scan electrode and the inner sustain electrode are separated by a first gap, wherein the inner sustain electrode and the middle sustain electrode are separated by a second gap. The inner scan electrode and the middle scan electrode are separated by a third gap. The first gap is smaller than either the second gap or the third gap.

In another embodiment of the plasma display panel, the inner sustain electrode is narrower than the middle sustain electrode and the middle sustain electrode is narrower than the outer sustain electrode. The inner scan electrode is narrower than the middle scan electrode and the middle scan electrode is narrower than the outer scan electrode.

In another embodiment of the plasma display panel, there is provided a pixel and at least one split electrode configured with at least a first electrode and a second electrode arranged to control plasma gas discharge at the pixel. A controller applies a first voltage to the first electrode and a second voltage to the second electrode independently of one another.

In another embodiment of the plasma display panel, the applying the first voltage to the first electrode and the second voltage to the second electrode (a) are performed during a sustaining discharge involving the first electrode and (b) encourage the sustaining discharge to extend to the second electrode.

In another embodiment of the plasma display panel, there is further provided a split electrode comprised of the first and second electrodes.

In another embodiment of the plasma display panel, there is further provided third, fourth, fifth and sixth electrodes. The first, second, third, fourth, fifth and sixth electrodes are an outer sustain electrode, a middle sustain electrode, an inner sustain electrode, an inner scan electrode, a middle scan electrode and an outer scan electrode, respectively. The controller applies voltages to each of the outer sustain electrode, middle sustain electrode, inner sustain electrode, inner scan electrode, middle scan electrode and outer scan electrode independently of one another.

In another embodiment of the plasma display panel, the inner scan electrode and the inner sustain electrode are separated by a first gap. The inner sustain electrode and the middle sustain electrode are separated by a second gap. The inner scan electrode and the middle scan electrode are separated by a third gap. The first gap is smaller than the either the second gap or the third gap.

In another embodiment of the plasma display panel, the applying voltages comprises: applying a first voltage waveform to the outer sustain electrode, applying a second voltage waveform to the middle sustain electrode, applying a third voltage waveform to the inner sustain electrode, applying a fourth voltage waveform to the inner scan electrode, applying a fifth voltage waveform to the middle scan electrode and applying a sixth voltage waveform to the outer scan electrode. The first, second, third, fourth, fifth and sixth voltage waveforms have relationships that (i) discourage an addressing discharge involving the inner sustain electrode and the inner scan electrode from extending to the middle sustain electrode and outer sustain electrode and to the middle scan electrode and the outer scan electrode, and (ii) permit a sustaining discharge involving the inner sustain electrode and the inner scan electrode to extend to the middle scan electrode and the outer sustain electrode and to the middle scan electrode and the outer scan electrode.

In another embodiment of the plasma display panel, the inner scan electrode and the inner sustain electrode are narrower than the middle and outer scan electrodes and the middle and outer sustain electrodes.

In another embodiment of the plasma display panel, the middle scan and middle sustain electrodes are narrower than the outer scan and outer sustain electrodes.

In another embodiment of the plasma display panel, the inner scan and inner sustain electrodes are substantially equal in width.

In another embodiment of the plasma display panel, the middle scan and middle sustain electrodes are substantially equal in width and the outer scan and sustain electrodes are substantially in width.

In another embodiment of the plasma display panel, a first gap separates the inner scan and sustain electrodes, a second gap separates the inner and middle scan electrodes and a third gap separates the inner and middle sustain electrodes. The first gap is narrower than the second and third gaps.

In another embodiment of the plasma display panel, a fourth gap separates the middle and outer scan electrodes and a fifth gap separates the middle and outer sustain electrodes. The second and third gaps are narrower than the fourth and fifth gaps.

In another embodiment of the plasma display panel, the second and third gaps are substantially equal and the fourth and fifth gaps are substantially equal.

In another embodiment of the plasma display panel, one or more of the outer sustain electrode, the middle sustain electrode, the inner sustain electrode, the inner scan electrode, the middle scan electrode and the outer scan electrode have a transparent electrode portion.

DESCRIPTION OF THE INVENTION

Elimination or suppression of vertical crosstalk between pixels allows for minimization of the size of an inter-pixel gap to maximize the pixel size, thereby increasing brightness.

Figure 1:
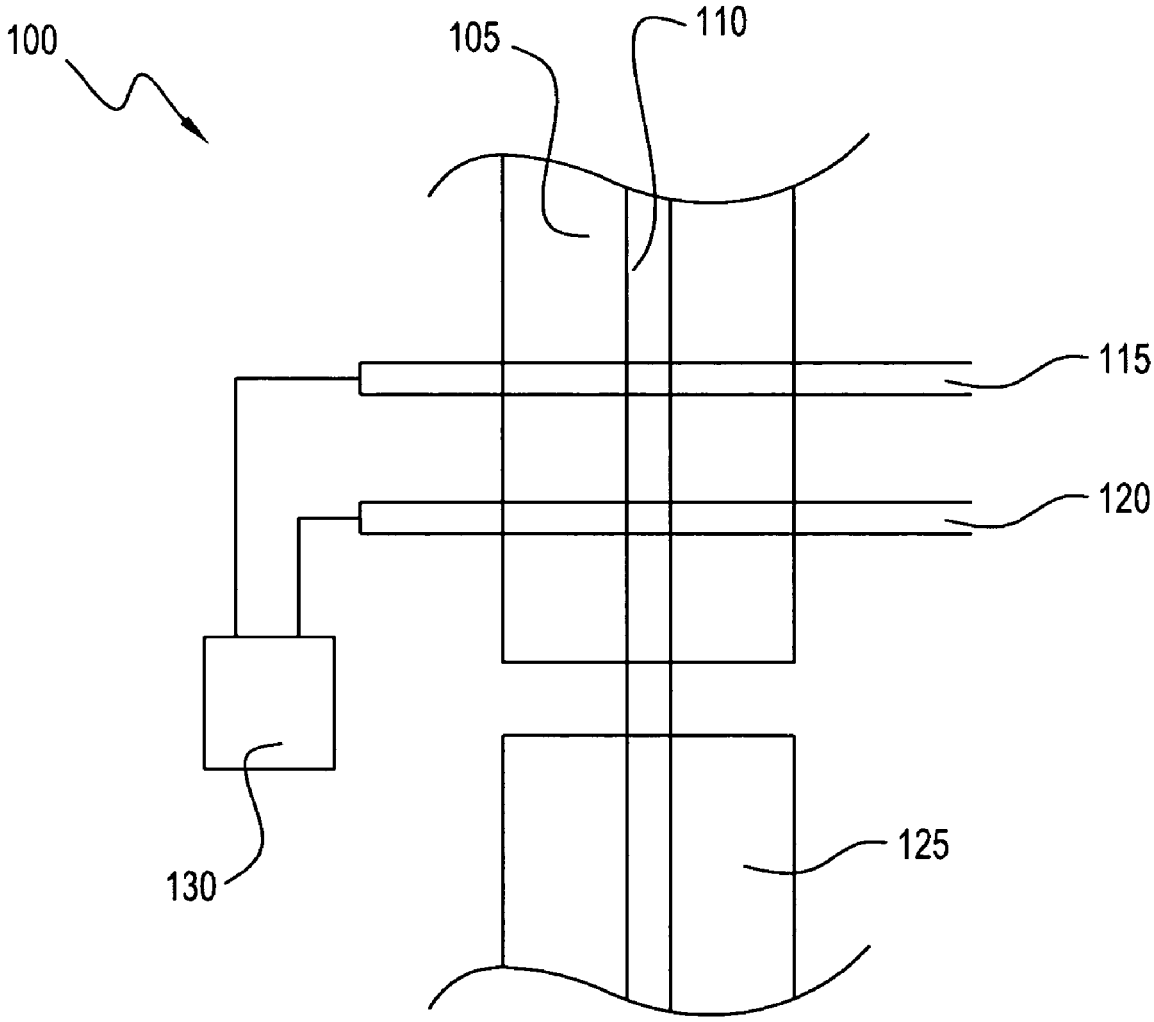
FIG. 1 is an illustration of a portion of a pixel configured in accordance with the present invention.

FIG. 1 is an illustration of a portion of a PDP 100, and more particularly a portion of a pixel 105 located at an intersection of a first electrode 115, a second electrode 120 and a data electrode 110. A controller 130 applies voltages to first electrode 115 and second electrode 120 to provide control of first electrode 115 and second electrode 120 independently of one another. The first voltage and the second voltage influence whether a discharge involving first electrode 115 extends to second electrode 120. First electrode 115 and second electrode 120 may operate as a split electrode.

During an addressing period, an addressing discharge is initiated between data electrode 110 and first electrode 115. During the addressing discharge, controller 130 applies a first voltage to first electrode 115, and applies a second voltage to second electrode 120. The first voltage and the second voltage have a relationship that discourages the addressing discharge from extending to second electrode 120.

Second electrode 120 is at an outer perimeter of pixel 105, thus first electrode 115 may be regarded as an inner electrode, and second electrode 120 may be regarded as an outer electrode. First electrode 115 may serve as an inner scan electrode where second electrode 120 serves as an outer scan electrode, such an arrangement being regarded as a split scan electrode. Similarly, first electrode 115 may serve as an inner sustain electrode where second electrode 120 serves as an outer sustain electrode, and similarly such an arrangement is regarded as a split sustain electrode.

A pixel 125 is vertically adjacent to pixel 105. As the addressing discharge is discouraged from extending to second electrode 120, it is also discouraged from extending to pixel 125. Thus, crosstalk from pixel 105 to pixel 125 is suppressed.

A pixel is an individually addressable picture element. The term sub-pixel is used herein to mean an individually addressable red, green or blue pixel. As a sub-pixel is individually addressable, it is also a form of pixel. Thus, the term "pixel", in general, can mean either (a) a sub-pixel of an individual color or (b) a red sub-pixel, a green sub-pixel and a blue sub-pixel in a group.

During a sustaining discharge involving first electrode 115, controller 130 applies a voltage to first electrode 115, and applies a voltage to second electrode 120 to encourage the sustaining discharge to extend to second electrode 120.

Although not represented in FIG. 1, first electrode 115 and second electrode 120 may be two electrodes of a split electrode pair. Furthermore, pixel 105 may be configured to have two split electrode pairs, namely, a split sustain electrode and a split scan electrode. The split sustain electrode is configured with an outer sustain electrode and an inner sustain electrode. The split scan electrode is configured with an inner scan electrode and an outer scan electrode.

On alternating sustaining discharges, a voltage is applied to the inner scan electrode or the inner sustain electrode while another voltage is applied to the outer scan electrode or the outer sustain electrode respectively. As the voltage applied to the outer scan electrode or the outer sustain electrode is increased above a minimum required voltage to effectively discharge the outer scan electrode or outer sustain electrode, additional brightness may be achieved as discharge power is increased.

Figure 2:
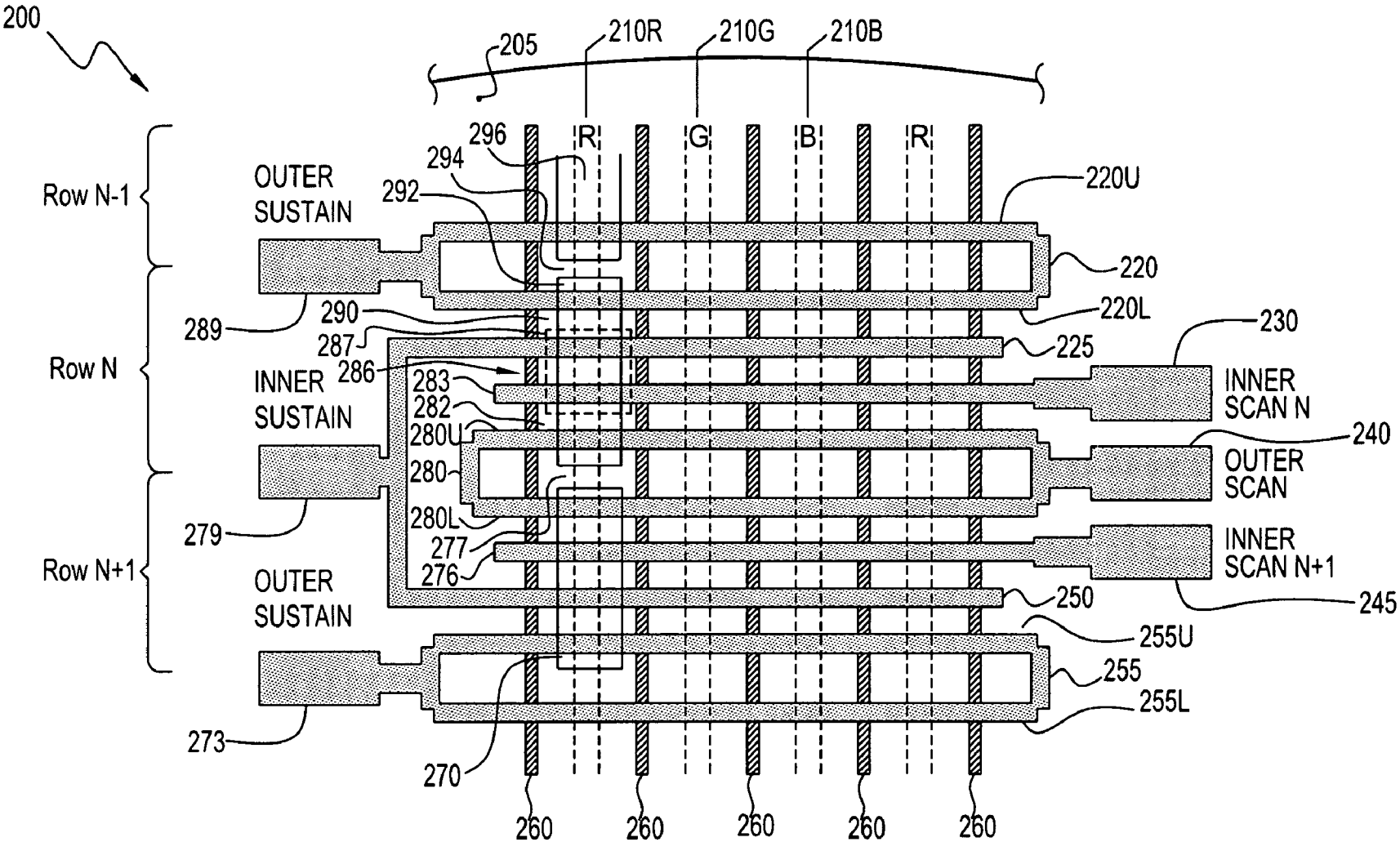
FIG. 2 is an illustration of a portion of a PDP configured with split electrodes.

FIG. 2 is an illustration of a portion of a PDP 200 configured with split electrodes. Additionally, as explained below, some of the electrodes of PDP 200 are also configured as loop electrodes. A loop electrode services two adjacent pixel discharge sites separated by an inter-pixel gap. For further information relating to loop electrodes, see U.S. Pat. No. 5,852,347 to Marcotte. Additionally, an isolated or non-conductive contrast enhancement bar may be placed within the loop electrode to reduce light reflectivity.

PDP 200 includes outer sustain electrode terminals 289 and 273, an inner sustain electrode terminal 279, inner scan electrode terminals 230 and 245, and an outer scan electrode terminal 240. Outer sustain electrode terminal 289 is connected to an outer sustain electrode 220. Inner sustain electrode terminal 279 is connected to inner sustain electrodes 225 and 250. Inner scan electrode terminal 230 is connected to an inner scan electrode 283. Outer scan electrode terminal 240 is connected to an outer scan electrode 280. Inner scan electrode terminal 245 is connected to an inner scan electrode 276. Outer sustain electrode terminal 273 is connected to an outer sustain electrode 255.

Outer sustain electrode 220 is configured as a loop electrode having an upper portion 220U and a lower portion 220L. Upper portion 220U services a sub-pixel 296, and lower portion 220L services a sub-pixel 292. Outer sustain electrode 220 has an interior region between upper portion 220U and lower portion 220L that provides an inter-pixel gap 294 between sub-pixels 296 and 292.

Outer scan electrode 280 is configured as a loop electrode having an upper portion 280U and a lower portion 280L. Upper portion 280U services sub-pixel 292 and lower portion 280L services a sub-pixel 270. Outer scan electrode 280 has an interior region between upper portion 280U and lower portion 280L that provides an inter-pixel gap 277 between sub-pixels 292 and 270.

Outer sustain electrode 255 is configured as a loop electrode having an upper portion 255U and a lower portion 255L. Upper portion 255U services sub-pixel 270 and lower portion 255L services an adjacent sub-pixel (not shown).

PDP 200 also includes a back plate 205 having vertical barrier ribs 260 and data electrodes 210R, 210G, and 210B, which are coated with red, green, or blue phosphor, respectively. Barrier ribs 260 maintain a substrate gap between a front plate (not represented in FIG. 2) and back plate 205 and also separate data electrodes 210R, 210G, and 210B from one another.

Back plate 205 may be fabricated either with or without horizontal pixel separators (not shown). Horizontal pixel separators are center aligned within the front plate inter-pixel gaps 294 and 277, to prevent discharge crosstalk between vertically adjacent pixel sites. As the outer scan or sustain electrode voltages are increased for added brightness, such separators become advantageous.

Sub-pixel 292 is located at the intersection of data electrode 210R, outer sustain electrode lower portion 220L, inner sustain electrode 225, inner scan electrode 283, and outer scan electrode upper portion 280U. Sub-pixel 292 is in a row, arbitrarily designated as row N. Sub-pixel 292 includes a sustain gap 286 between inner sustain electrode 225 and inner scan electrode 283. It also includes a gap 290 between outer sustain electrode lower portion 220L and inner sustain electrode 225, and a gap 282 between inner scan electrode 283 and outer scan electrode upper portion 280U.

Sub-pixel 270 is in a row N+1, adjacent to sub-pixel 292. Note that sub-pixel 270 is located at an intersection of data electrode 210R, and outer scan electrode lower portion 280L, inner scan electrode 276, inner sustain electrode 250, and outer sustain electrode upper portion 255U.

Sub-pixel 296, only a portion of which is shown in FIG. 2, is in a row N−1, adjacent to sub-pixel 292. Note that sub-pixel 296 is located at an intersection that includes data electrode 210R and outer sustain electrode upper portion 220U.

Outer sustain electrode lower portion 220L and inner sustain electrode 225 are collectively referred to as a split sustain electrode. Similarly, inner scan electrode 283 and outer scan electrode upper portion 280U are collectively referred to as a split scan electrode. Gaps 290 and 282 are then referred to as split electrode gaps.

Outer sustain electrode lower portion 220L is at an upper outer perimeter of sub-pixel 292, and outer scan electrode upper portion 208U is at a lower outer perimeter of sub-pixel 292. During addressing periods, outer sustain electrode 220 is electrically driven to discourage vertical crosstalk between sub-pixel 292 and sub-pixel 296. Likewise during addressing, outer scan electrode 280 is driven to discourage, and preferably prevent, crosstalk between sub-pixel 292 and sub-pixel 270. As a result, addressing discharges are limited to an inner electrode area 287, reducing addressing discharge current as compared to discharging the entire sub-pixel 292. During alternating sustaining discharges of sub-pixel 292, outer scan electrode 280 is driven to encourage the discharge to extend beyond inner scan electrode 283, and discharge outer scan electrode upper portion 280U. Inter-pixel gap 277 is sized to prevent vertical crosstalk, and/or horizontal separators are included in the fabrication of barrier ribs 260 at the center of inter-pixel gap 277. Similarly, outer sustain electrode 220 is driven to encourage the discharge to extend beyond inner sustain electrode 225, and discharge outer sustain electrode lower portion 220L. Inter-pixel gap 255 is sized to prevent vertical crosstalk, and/or horizontal separators are included in the fabrication of barrier ribs 260 at the center of inter-pixel gap 294.

Figure 3:
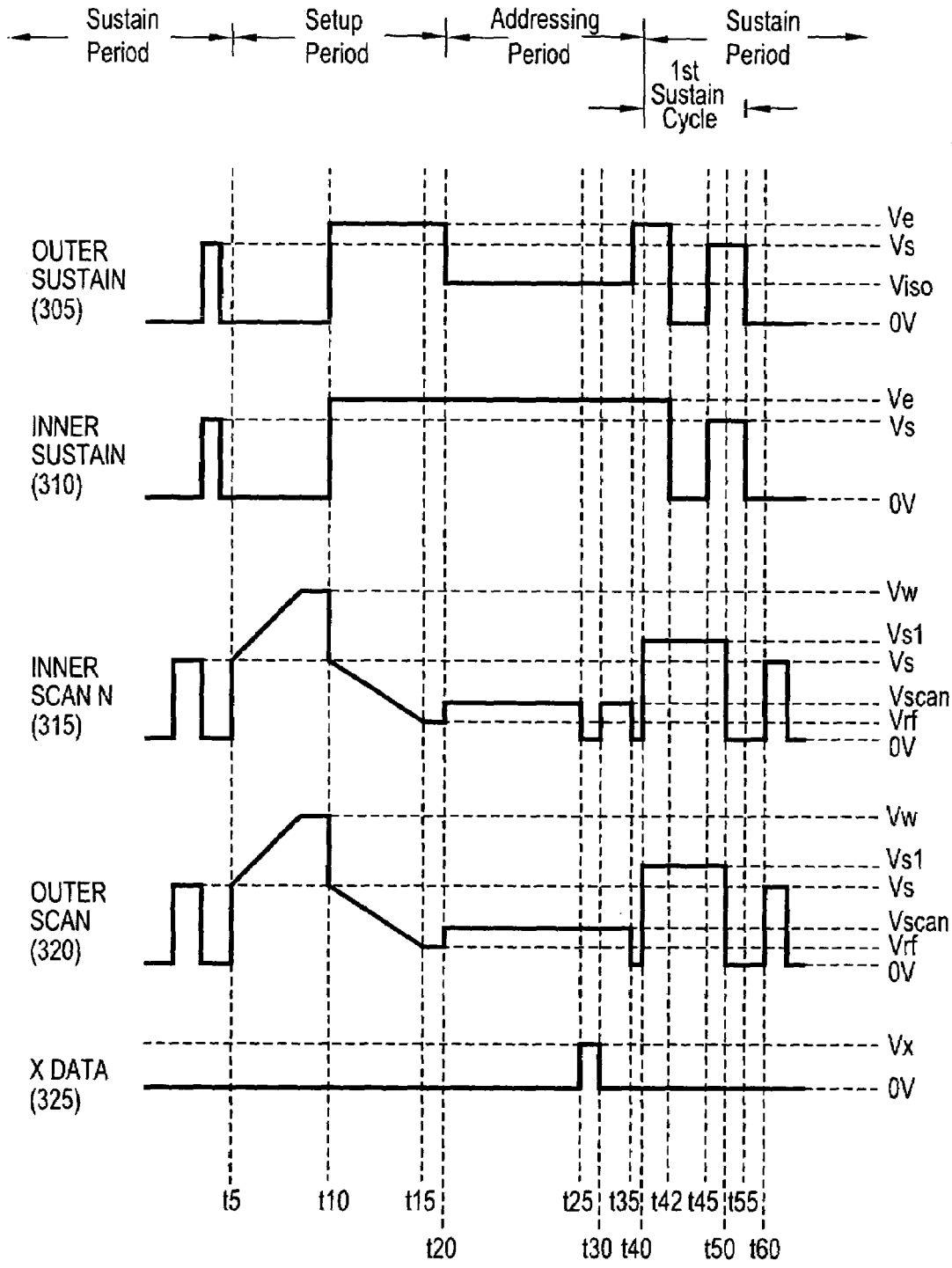
FIG. 3 is a graph of a set of voltage waveforms for driving the electrodes of FIG. 2.

FIG. 3 is a graph of a set of voltage waveforms for driving the electrodes of FIG. 2. For example, an outer sustain waveform 305 drives outer sustain electrode 220, an inner sustain waveform 310 drives inner sustain electrode 225 and 250, an inner scan waveform 315 drives inner scan electrode 283, an outer scan waveform 320 drives outer scan electrode 280, and X data waveform 325 drives data electrode 210R. The horizontal axis of FIG. 3 represents time and the vertical axis represents voltage, however, neither of the horizontal nor vertical axis is drawn to scale.

Plasma displays partition a 60 Hz display frame into 8 to 12 pulse width modulated sub-fields. Each sub-field produces a portion of the light required to achieve a proper intensity of each pixel. Each sub-field is partitioned into a setup period, an addressing period and a sustain period. The sustain period is further partitioned into a plurality of sustain cycles. The waveforms of FIG. 3 apply to one such sub-field, and the left hand side of FIG. 3 shows an end of a sustain period of a previous sub-field.

A current sub-field begins with a setup period, which resets any ON sub-pixels to an OFF state, and provides priming to the gas and MgO surface to allow for subsequent addressing. The intent is to place each sub-pixel at a voltage very close to a firing voltage of the gas. For example, when setting up sub-pixel 292, during time t5-t15 weak discharges are produced such that a resulting voltage, within the panel, between data electrode 210R and inner sustain electrode 225, relative to a voltage on inner scan electrode 283, is the gas mixture's firing voltage.

After each sub-pixel is setup, the addressing period begins. In the addressing period, each row may be sequentially selected via a row select pulse, as shown on inner scan waveform 315 for a row N at t25-t30. If concurrently, a data voltage is applied to a sub-pixel's data electrode, e.g., a pulse at time t25 on the X data waveform, then an addressing discharge will occur, setting the sub-pixel into the ON state.

On inner scan waveform 315 there is a row select pulse at time t25 to select row N, i.e., the row in which inner scan electrode 283 is located. Note that a row select for inner scan electrode 276, which is in row N+1, would be applied at a time other than time t25. Note also that inner scan waveform 315 and outer scan waveform 320 are identical to one another, except for the row select pulse at time t25. Also during the addressing period, and more particularly during an interval from time t20 to time t35, outer sustain waveform 305 is at a voltage Viso, while inner sustain waveform 310 is at a voltage Ve, where Viso is less than Ve.

X data waveform 325 has a positive going data pulse at time t25. This data pulse being concurrent with the row select pulse on inner scan waveform 315 at time t25, initiates an addressing discharge in sustain gap 286 to turn ON sub-pixel 292. The addressing discharge forms between data electrode 210R and inner scan electrode 283. Moments after the addressing discharge is initiated, the positive column of the discharge spreads across sustain gap 286 to inner sustain electrode 225.

During the addressing period, since outer sustain electrode 220 is driven negatively (Viso) with respect to inner sustain electrode 225 (Ve), the addressing discharge will not progress across gap 290 to outer sustain electrode lower portion 220L. Similarly, since outer scan electrode 280 is driven positively to a voltage Vscan, which is the row de-select voltage, the addressing discharge is prevented from progressing across gap 282 to outer scan electrode upper portion 280U. Since the discharge currents are proportional to the discharge electrode area, the addressing discharge currents are greatly diminished as the addressing area 287 is an area between inner sustain electrode 225 and inner scan electrode 283 in sub-pixel 292.

After being addressed, a sub-pixel is repetitively discharged in the sustain period to produce a desired brightness.

In the sustain period, if sub-pixel 292 was addressed during the addressing period, i.e., if an addressing discharge was initiated at time t25, then a number of sustaining discharges are produced in sustain gap 286. The number of sustaining discharges produced in the sustain period is related to the desired brightness for sub-pixel 292. Each sub-field typically has a different number of sustain pulses within a sustain period.

In the sustain period, outer sustain waveform 305 and inner sustain waveform 310 are identical to one anther, and inner scan waveform 315 and outer scan waveform 320 are identical to one another. Accordingly, for convenience, when discussing the sustain period, (a) outer and inner sustain waveforms 305 and 310 are collectively referred to as the sustain waveform, and (b) inner and outer scan waveforms 315 and 320 are collectively referred to as the scan waveform. Pulses of voltage Vs are applied to outer and inner sustain electrodes 220 and 225, and alternated with pulse of voltage Vs being applied to inner and outer scan electrodes 283 and 280, to repetitively discharge sub-pixel 292.

A first sustaining discharge occurs between times t42 and t45. At times t40 and t42, the sustain waveform and scan waveform voltage polarities are reversed with respect to the addressing period so that the first sustaining discharge will produce a current flow from the scan electrode toward the sustain electrode. Between time t42 and t45, a sustaining discharge forms at sustain gap 286 with the positive column spreading across inner scan electrode 283, gap 282, and outer scan electrode upper portion 280U. That is, during the sustain period, the sustaining discharges are permitted to extend to outer scan electrode upper portion 280U. The scan waveform provides a high sustain voltage Vs1 to inner and outer scan electrodes 283 and 280, thus providing ample voltage for the positive column to spread quickly across gap 282. As a result, gap 282 can be wider than sustain gap 286. As the slow moving negative glow expands due to the larger positive column it spreads across inner sustain electrode 283, gap 290, and outer sustain electrode lower portion 220L.

Such an embodiment can be operated with line widths from 40 to 100 microns and with sustain gap and split electrode gaps of 60 to 120 microns. Since the light must pass around opaque electrodes, it is advantageous to have narrower lines and larger spaces.

Figure 4:
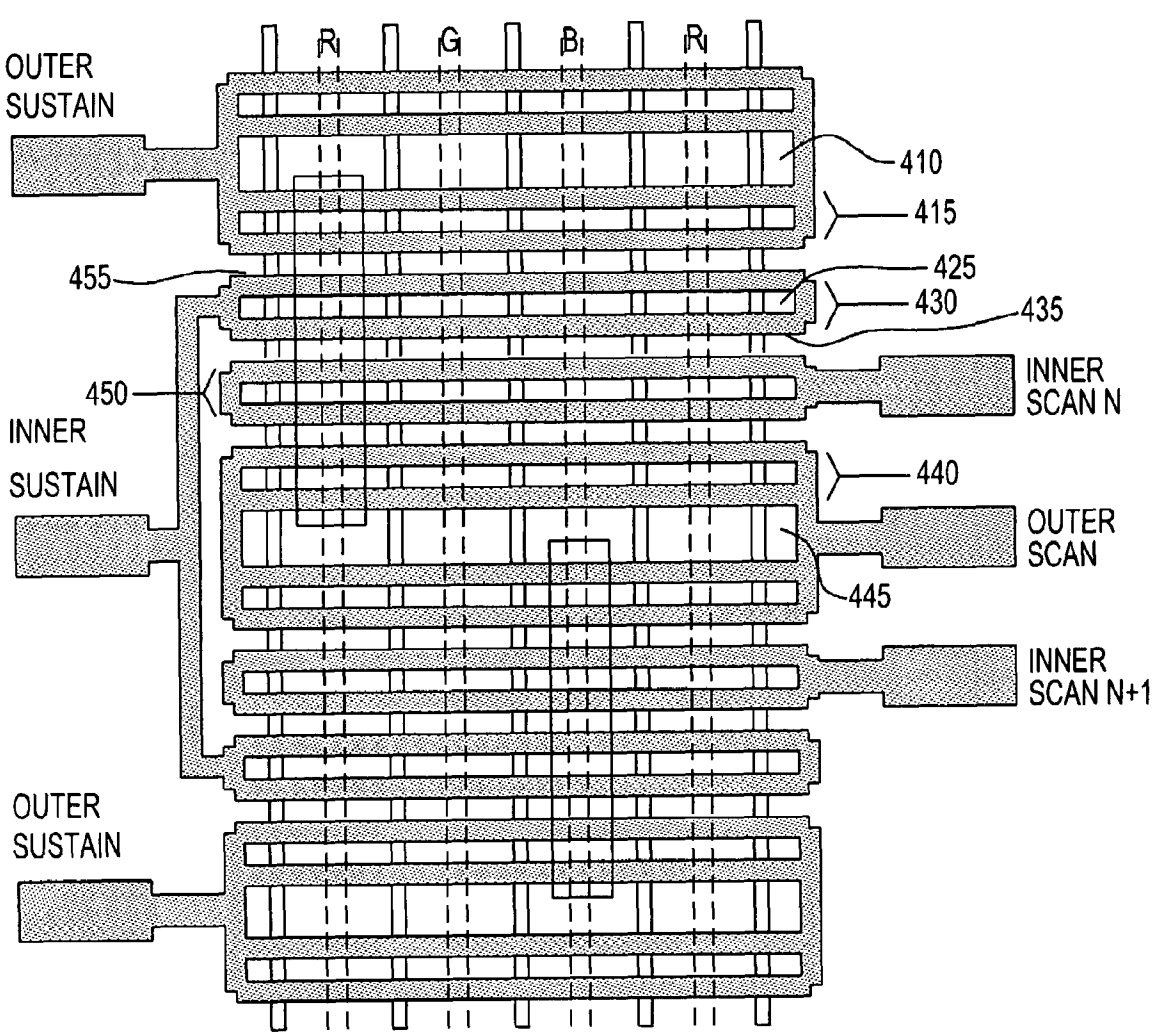
FIG. 4 is an illustration of a portion of a PDP configured with split electrodes having horizontal electrode lines with shorting bars at each end.

FIG. 4 is an illustration of a portion of a PDP 400, similar to that of PDP 200, where in place of electrodes 220L, 225, 283 and 280U, there are non-transparent apertured electrodes 415, 430, 450 and 440 respectively. Each apertured electrode includes two opaque horizontal lines enclosing an aperture. For example, apertured electrode 430 includes two opaque electrodes 420 and 435 enclosing an aperture 425. Similarly to PDP 200, the outer sustain apertured electrodes 405 and 415 and outer scan apertured electrodes are looped about inter-pixel gaps 410 and 445. In such a configuration, each apertured electrode will behave, as a solid electrode provided its aperture is not too large. Typical electrode line widths of 40 microns and apertures of 80 microns provide such a characteristic. Consequently, it is advantageous to make gap 455 equal to the spacing of aperture 425. Additional shorting bars (not shown) may be placed within apertures, e.g., within aperture 425, to bypass photolithographic open defects. For example, see U.S. Pat. No. 6,411,035 to Marcotte.

The configuration of two horizontal lines, e.g., 420 and 435, forming the apertured electrodes of PDP 400, can be modified to vary the number of horizontal lines and apertures in either the outer apertured electrodes, e.g., electrodes 415 or 440, or the inner apertured electrodes, e.g., electrodes 430 or 450, to control a ratio of addressing discharge capacitance versus sustaining discharge capacitances. For example, a single horizontal electrode line could be implemented for the inner scan and inner sustain electrodes as in FIG. 2, e.g., inner sustain electrode 225 and inner scan electrode 283, while three or more horizontal electrode lines could be implemented to widen the outer apertured electrodes, 415 and 440.

The apertured electrode configuration of PDP 400 allows for larger pixels to be fabricated than that of PDP 200. Since the operating characteristics are determined by the horizontal line width and spacing, increasing the horizontal line width, the spacing between horizontal lines, or the number of horizontal lines and spaces can extend the pixel size. As the pixel size is extended, it is generally necessary to increase the sustain pulse voltage to ensure that the discharges extend to the outer edges of each sub-pixel.

Figure 5:
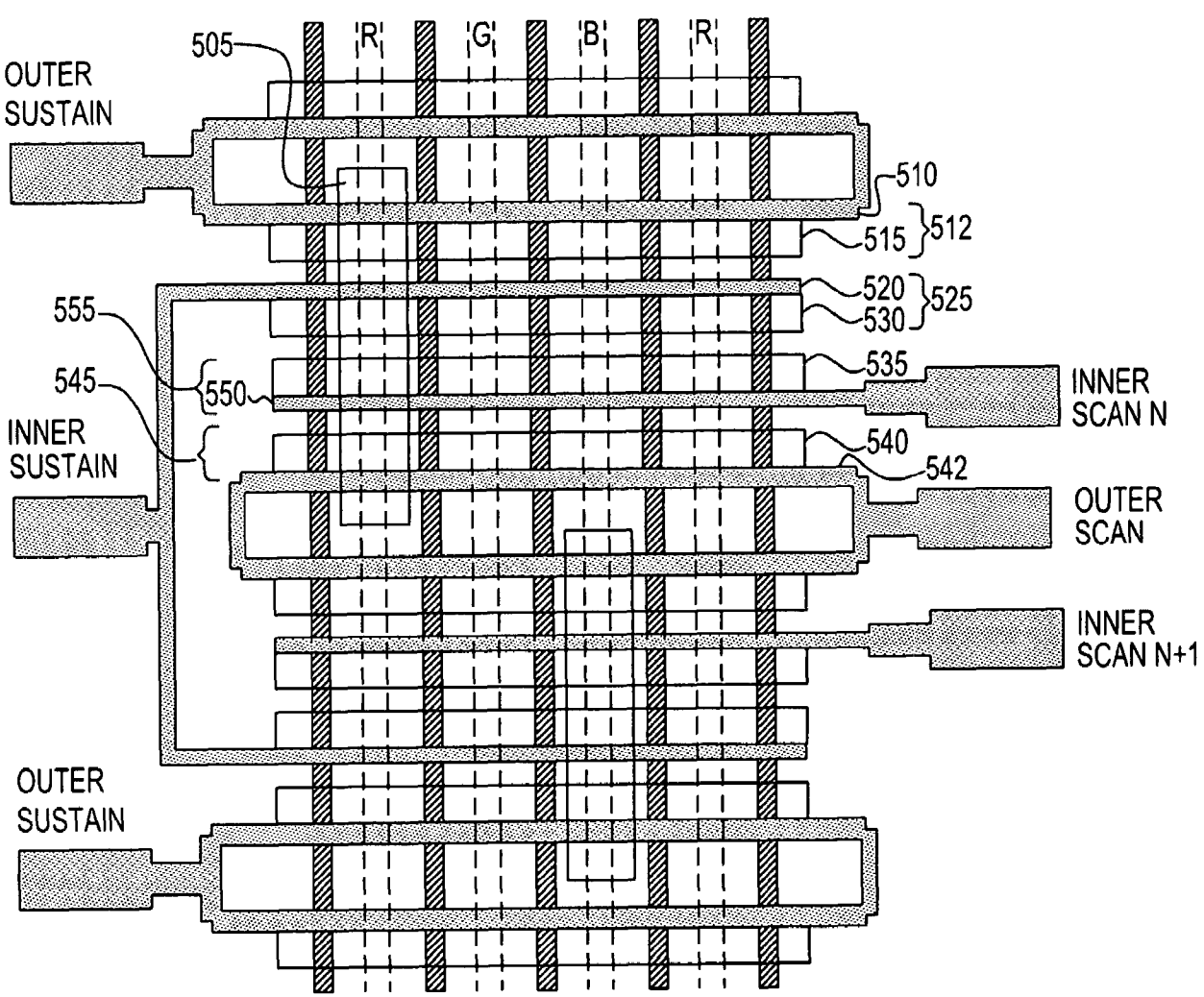
FIG. 5 is an illustration of embodiment of a PDP where an electrode is formed as transparent electrode overlaid with a metallic bus electrode.

FIG. 5 is an illustration of embodiment of a portion of a PDP 500 where an electrode includes an electrically conductive transparent region, i.e., a transparent electrode. PDP 500 has a sub-pixel 505 at an intersection of an outer sustain electrode 512, an inner sustain electrode 525, an inner scan electrode 555 and an outer scan electrode 545. Outer sustain electrode 512 is configured with a transparent electrode 515 overlaid with a portion of an opaque metallic loop electrode 510. Inner sustain electrode 525 is configured with a transparent electrode 530 overlaid with a metallic bus electrode 520. Inner scan electrode 555 is configured with a transparent electrode 535 overlaid with a metallic bus electrode 550.

Outer scan electrode 545 is configured with a transparent electrode 540 overlaid with a portion of an opaque metallic loop electrode 542.

This configuration of electrodes, i.e., a transparent electrode overlaid with a metal electrode, provides high brightness and excellent brightness uniformity. The high brightness results from high discharge capacitance. With high discharge capacitance, large discharges are much more apt to over spread and create vertical crosstalk. Additionally, the high capacitance reduces addressing operating margin due to voltage drops caused by high addressing discharge currents. Accordingly, on inner sustain electrode 525 and inner scan electrode 555, the transparent conductor width of transparent electrodes 530, 535 may be reduced or removed to reduce the address currents, and on outer sustain electrode 512 and outer scan electrode 545, transparent electrodes 515 and 540 may be widened to supply increased sustaining discharge power.

Figure 6:
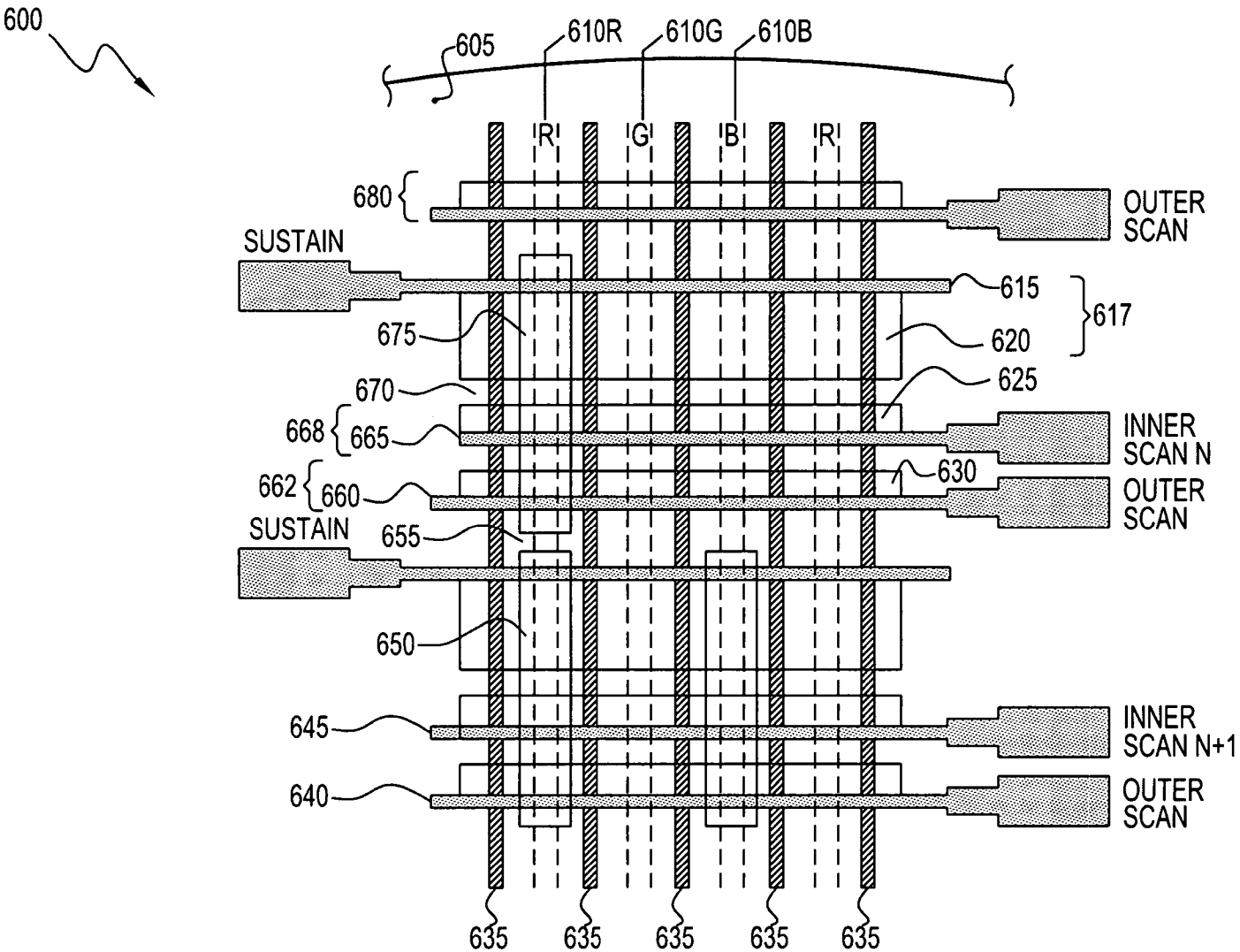
FIG. 6 is an illustration of a portion of a PDP having a sub-pixel with a three-electrode configuration.

FIG. 6 is an illustration of a portion of a PDP having a sub-pixel with a three-electrode configuration. A PDP 600 includes a back plate 605 having vertical barrier ribs 635 and data electrodes 610R, 610G and 610B coated with red, green, or blue phosphor, respectively. PDP 600 also includes a sustain electrode 617, an inner scan electrode 668, and an outer scan electrode 662.

Sustain electrode 617 is configured with a transparent electrode 620 overlaid with a metallic electrode 615. Inner scan electrode 668 is configured with a transparent electrode 625 overlaid with a metallic electrode 665. Outer scan electrode 662 is configured with a transparent electrode 630 overlaid with a metallic electrode 660. The metallic electrode material is an opaque metallic conductor.

A sub-pixel 675 is in a region at an intersection of data electrode 610R, sustain electrode 617, inner scan electrode 668, and outer scan electrode 662. Sub-pixel 675 is in a row N, and is vertically adjacent to a sub-pixel 650 in a row N+1. An outer scan electrode 680 is for a row N−1. A sustain electrode 632, an inner scan electrode 645 and an outer scan electrode 640 are for row N+1. An inter-pixel gap 655 lies between sub-pixels 675 and 650.

Sub-pixel 675 includes a sustain gap 670 located between sustain electrode 617 and inner scan electrode 668. Outer scan electrode 662 is at an outer perimeter of sub-pixel 675, and thus also borders inter-pixel gap 655. Outer scan electrode 662 is electrically driven to discourage vertical crosstalk from sub-pixel 675 to sub-pixel 650.

During an addressing discharge involving inner scan electrode 668, a first voltage is applied to inner scan electrode 668, and a second voltage is applied to outer scan electrode 662. By selecting appropriate levels for the first and second voltages, the addressing discharge that forms between back plate 605 and inner scan electrode 668 is discouraged from extending to outer scan electrode 662. The positive column will quickly engulf sustain electrode 617 while the negative glow will be limited to inner scan electrode 668.

Addressing current is limited by capacitance of inner scan electrode 668. Since outer scan electrode 660 is not involved in the discharge, the current is limited. PDP 600 offers improved brightness over PDP 500 due to the larger area of transparent electrode 620, and less light shading than that caused by metallic bus electrode 520.

Although PDP 600 is shown as being configured with sustain electrode 617, inner scan electrode 668 and outer scan electrode 662, the concept of suppressing vertical crosstalk can also be employed with inner and outer sustain electrodes. For example, sustain electrode 617 can be replaced with an inner sustain electrode and an outer sustain electrode that are controlled independently of one another to further limit the addressing discharge current. Thus, either or both of the sustain electrode and scan electrode can be configured with an outer electrode and an inner electrode.

Figure 7:
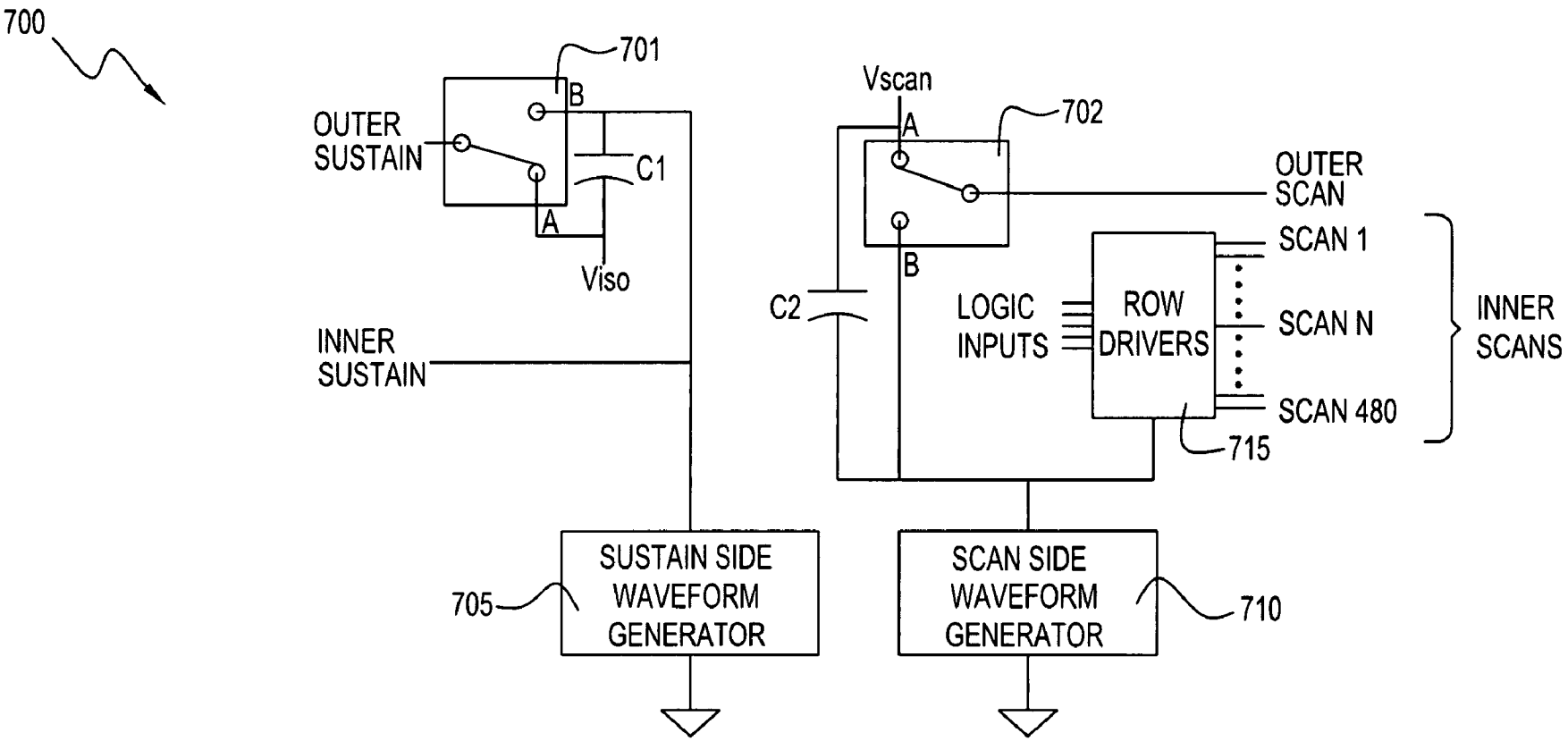
FIG. 7 is a block diagram of a circuit for producing the waveforms of FIG. 3.

FIG. 7 is a block diagram of a circuit 700 for producing the waveforms of FIG. 3. Circuit 700 is, in turn, composed of smaller circuits for controlling an outer sustain electrode, an inner sustain electrode, and inner scan electrode and an outer scan electrode independently of one another. Circuit 700 includes a sustain side waveform generator 705 and a scan side waveform generator 710.

Sustain side waveform generator 705 generates a sustain waveform that serves as a source for inner sustain waveform 310. The sustain waveform from sustain side waveform generator 705 is also routed to a switch 701 to serve as a source for outer sustain waveform 305.

Scan side waveform generator 710 generates a scan waveform. The scan waveform is presented to row drivers 715 that drive rows of scan lines, e.g., scan line 1 through scan line 480, and thus serves as a source for inner scan waveform 315 for row N. The scan waveform from scan side waveform generator 710 is also routed to a switch 702 to serve as a source for outer scan waveform 320.

Each of switches 701 and 702 can be set to either a position A or a position B. In FIG. 7, switches 701 and 702 are shown in position A as they would be connected during the addressing period, e.g., from time t20 to time t40 in FIG. 3, to provide voltages for controlling the outer sustain electrode and the outer scan electrode to restrain the addressing discharge. Referring to the sustain side, the sustain electrodes are driven directly from sustain side waveform generator 705. The isolation voltage Viso is a non-grounded voltage, for example, floating 50 to 100 volts below the output voltage of sustain side waveform generator 705.

On the scan side, row drivers 715 are totem pole output row drivers that scan each row during the addressing period. There is a separate output for each display row connected to a respective inner scan electrode through terminals 230 and 245. During the addressing period, the scan side waveform generator 710 generates a voltage Vscan of 75-150 volts. The outer scan electrodes and the high side of the totem pole outputs within row drivers 715 are tied to a common point of switch 702, which provides a positive voltage relative to the output of scan side waveform generator 710. This positive voltage provides a row de-select level during the addressing period.

During the addressing period, each inner scan electrode is sequentially pulsed low, to 0 V, to enable addressing of a selected row. An addressing discharge will then form at each sub-pixel site where an X-data electrode is driven to 50-75 volts.

During time periods other than the addressing period, switches 701 and 702 are set to position B so that the outer sustain electrode is driven directly from sustain side waveform generator 705, and the outer scan electrode is driven directly from scan side waveform generator 710.

Each of the embodiments described herein reduces the peak addressing discharge current, which occurs when all the pixels on a given line are addressed, and so lessens the current requirements of row drivers 715. Furthermore, the sustaining discharge currents occurring during the sustain period are channeled from the outer scan electrodes through switch 702, around, not through, row drivers 715. The sustain currents from the individual inner scan electrodes will flow through the lower transistor of the totem pole outputs of row drivers 715. In practice, each switch 701 and 702 uses a pair of high current transistors such as metal oxide semiconductor transistors (MOSFETs) or insulated gate bipolar transistors (IGBTs).

When scan and sustain electrodes are configured as split electrodes, (i.e., inner and outer scan electrodes, and inner and outer sustain electrodes), alternate driving techniques may be devised to utilize the split electrode configuration to further improve operating characteristics.

A first driving technique improves dark screen contrast ratio. Background glow light, produced by a setup voltage waveform producing a weak setup discharge, is contained to a center region of each sub-pixel site. Such a setup voltage waveform drives the outer electrodes with lower setup voltages while the prior voltage levels are used to drive the inner electrodes to discourage the setup discharge from extending to the outer regions of each sub-pixel. Reducing the setup discharge area, reduces the setup discharge light, and therefore improves the dark screen contrast ratio.

A second driving technique applies to the sustain time period. The outer electrodes of each split electrode pair are driven with higher sustain pulse voltages providing additional voltage to the outer electrodes to draw the discharge to the outer limits of each sub-pixel site. This allows the sustain voltage itself to be reduced which improves sustain luminous efficiency and also improves operating voltage margin.

For example, FIG. 2 details each split electrode pair. Sustain gap 286 is at the center of sub-pixel 292 separating inner sustain electrode 225 and inner scan electrode 283. Outer scan electrode 280 is separated from inner scan electrode 283 by gap 282. Outer sustain electrode 220 is separated from inner sustain electrode 225 by gap 290. In general, gaps 290 and 282 will be the same size as one another.

An improved dark screen contrast ratio is achieved by utilizing the row drivers 715 during the setup period to create a setup voltage waveform that applies the voltage Vscan to inner scan electrode 283 during the rising setup ramp (see FIG. 3, time t5 to time t10). The setup voltage waveform for outer scan electrode 280 does not have this voltage applied, as the scan side waveform generator 710 at time t10 reduces its output from a setup voltage Vw by an amount equal to the voltage Vscan, e.g., 90-120 volts. With a reduced voltage applied to outer scan electrode 280, a weak positive resistance setup discharge, which occurs during the rising ramp (time t5 to time t10), is contained to inner scan electrode 283 where the higher voltage is present and is discouraged from extending to outer scan electrode 280, thus reducing the light produced by the setup discharge.

Applying a higher voltage to the outer electrodes in each split pair, where higher voltages are required, may optimize sustaining discharge characteristics. A high electric field present at sustain gap 286, which is relatively narrow, for example, about 80 microns, offers a relatively low initial firing voltage. However the voltage required for the sustaining discharge to spread fully across sub-pixel 292 may be 50 to 100 volts higher depending on dimensions of sub-pixel 292 and gas mixture. As a result, if a single sustain voltage is applied to fully discharge sub-pixel 292, the center region of sub-pixel 292 is over-energized, where as at its extremes it is under-energized. If inner electrodes 225 and 283 are driven with the low ignition voltage, and outer electrodes 220 and 280 are driven with relatively higher voltage, then improvements in luminous efficiency and lifetime may be achieved.

Figure 8:
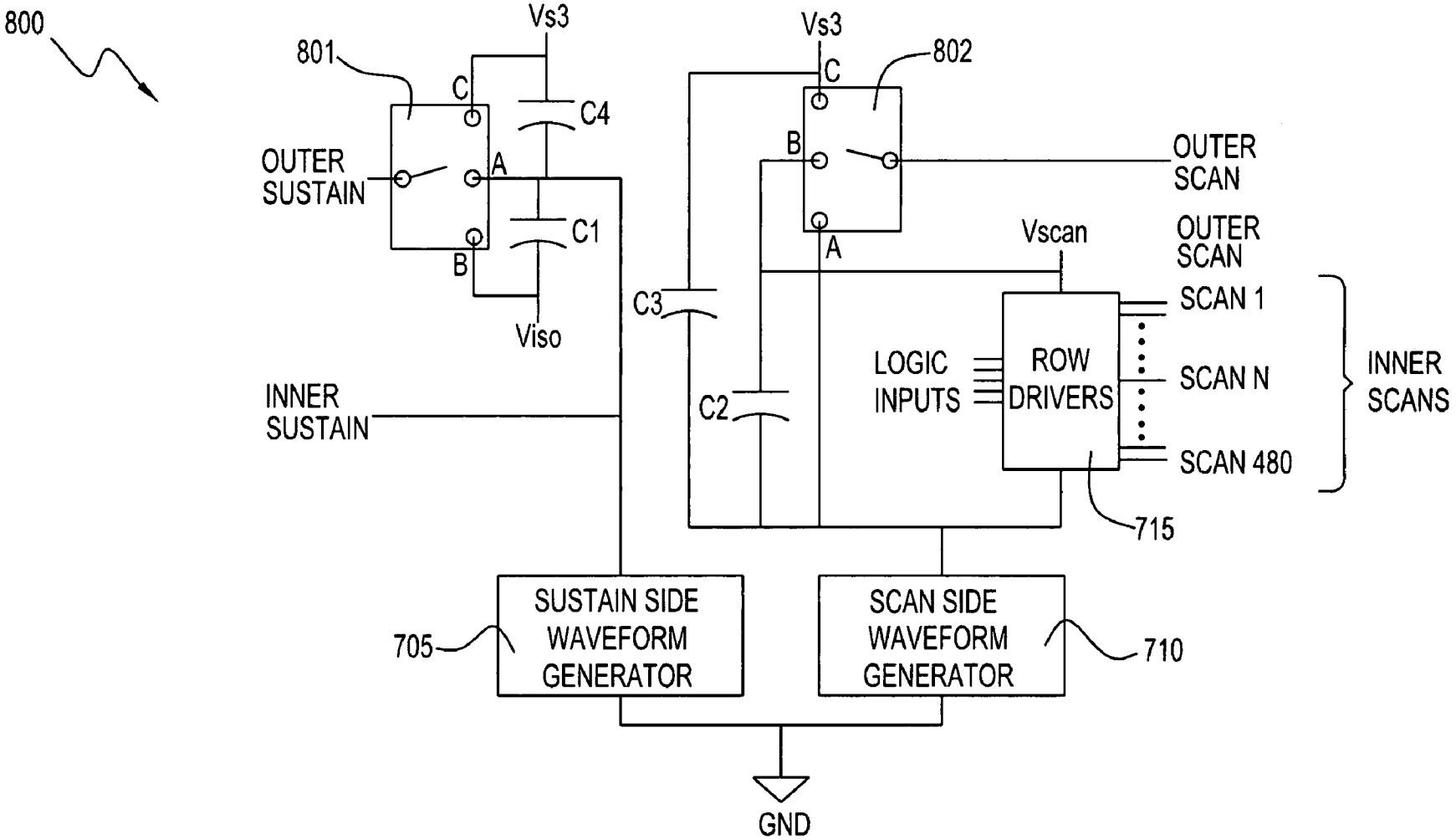
FIG. 8 is a block diagram of a circuit for controlling electrodes of a PDP.
Figure 9:
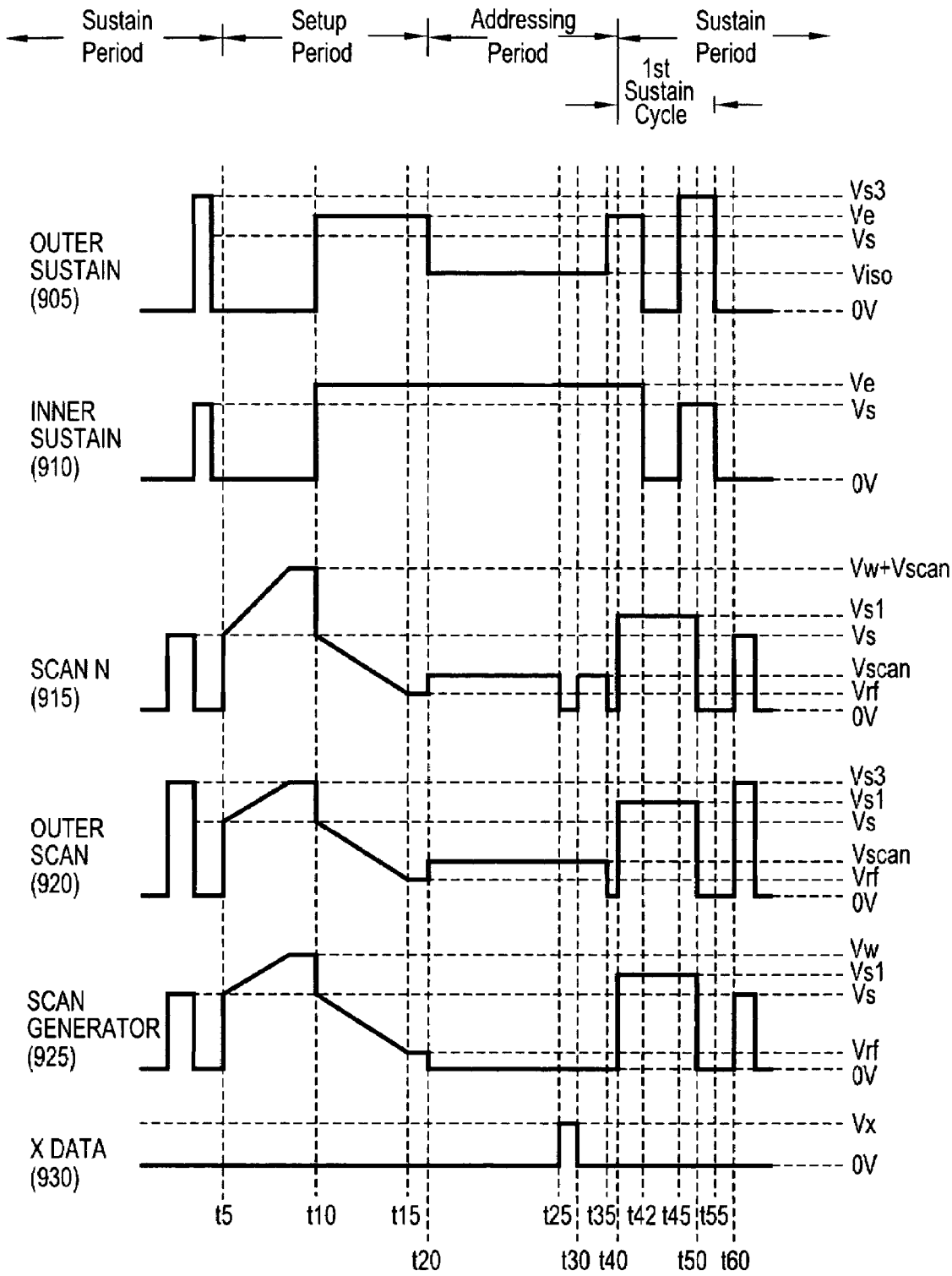
FIG. 9 is a graph of a set of voltage waveforms produced by the circuit of FIG. 8.

FIG. 8 is a block diagram, similar to FIG. 7, of a circuit 800 for controlling electrodes of a PDP. Circuit 800 is, in turn, composed of smaller circuits for controlling the electrodes. FIG. 9, described below in greater detail, shows a set of waveforms produced by circuit 800.

Circuit 800 includes a switch 801 and a switch 802. Each of switches 801 and 802 have positions A, B and C.

Switch 802, during the setup period, is set to position A to allow outer scan electrode 280 to be driven directly by scan side waveform generator 710. During the addressing period, switch 802 is set to position B to provide an offset voltage Vscan to outer scan electrode 280. During the sustain period, an additional offset voltage, Vs3, may be switched ON with each sustain pulse by setting switch 802 to position C to boost the amplitude of each pulse to outer scan electrode 280.

In contrast with circuit 700, row drivers 715 have a voltage Vscan applied constantly for simplicity. "Latching up" is a parasitic condition caused by high currents flowing in a substrate of an integrated circuit. Actual row driver devices may require that Vscan, which is typically a relatively high voltage, be removed during the sustain period to prevent row drivers 715 from "latching up".

Voltages Vscan and Vs3 are AC coupled from scan side waveform generator 710, through capacitors C2 and C3, respectively, providing offset voltages that float with the output of scan side waveform generator 710. The voltage applied to outer scan electrode 280 can be switched between the output of scan side waveform generator 710, the voltage Vscan, and an additional voltage, Vs3, above the output of scan side waveform generator 710. Similarly, row drivers 715 can switch each row, independently, between the output of scan side waveform generator 710 and a voltage, Vscan, above the output of scan side waveform generator 710.

Switch 801, during the setup period, is set to position A to allow outer sustain electrode 220 to be driven directly by sustain side waveform generator 705. During the addressing period, switch 801 is set to position B to provide an AC coupled isolation voltage, Viso, to suppress vertical crosstalk. During the sustain period, switch 801 is set to position C to permit an AC coupled voltage, Vs3 to be applied to outer sustain electrode 220, synchronously with each sustain side sustain pulse, to provide additional amplitude to each pulse.

FIG. 9 is a graph, similar to that of FIG. 3, of a set of voltage waveforms produced by circuit 800. FIG. 9 shows an outer sustain waveform 905, and inner sustain waveform 910, an inner scan waveform 915 and outer scan waveform 920, a scan generator waveform 925 and an X data waveform 930.

Outer sustain waveform 905 is applied to outer sustain electrode 220. Inner sustain waveform 910 is applied to inner sustain electrode 225. Inner scan waveform 915 is applied to inner scan electrode 283. Outer scan waveform 920 is applied to outer scan electrode 280. Scan generator waveform 925 is generated by scan side waveform generator 710. X data waveform 930 is applied to data electrode 210R.

Relative to FIG. 3, the scan waveform generator voltage Vw in FIG. 9 has been reduced by an amount equal to the Vscan voltage, between 75 and 150V. Since row drivers 715 are referenced to the output of scan side waveform generator 710, row drivers 715 may be switched to output voltage Vscan during time interval t5 to t10 to produce the scan N waveform 915, which is applied to the inner scan electrode for row N, i.e., inner scan electrode terminal 283. During the setup period, t5 to t20, switch 802 is set in position A so that the outer scan electrode 280 is driven with the outer scan waveform 920, which is the same as scan generator waveform 925.

At time t5, row drivers 715 are driven high to the voltage Vscan that is referenced to the output of scan side waveform generator 710 through a capacitor C2. Since row drivers 715 are referenced to the output of scan side waveform generator 710, and since scan generator waveform 925 ramps at time t5, inner scan waveform 915 follows the ramp with an offset of Vscan volts. The slow ramp, coupled with the voltage approaching Vw+Vscan, creates a weak non-avalanching positive resistance discharge with inner scan electrode 283 discharging to both data electrode 210R and inner sustain electrode 225. This discharge forms the first half of the background glow intensity of the display. Since inner scan electrode 283 sources this discharge, a lower voltage ramp on outer scan electrode 280 from outer scan waveform 920 does not discharge and thus reduces the size of the physical area being discharged, thereby reducing the background glow intensity.

At time t10, referring to inner scan waveform 915, outputs of row drivers 715 are switched to their low level, which is equal to the output of the scan side waveform generator 710 (see scan generator waveform 925). As scan generator waveform 925 ramps down during time t10 to time t15, inner scan waveform 915 will follow. Recall that during the setup period, switch 802 is set to position A, and therefore, outer scan waveform 920 will also ramp down. As the setup voltage waveform voltage ramps down, a slow positive resistance setup discharge will again occur, this time being sourced by data electrode 210R and inner sustain electrode 225. Since outer sustain electrode 220 and outer scan electrode 280 were not included in the rising ramp's setup discharge between time t5 and time t10, they do not have sufficient wall charge to discharge during the falling ramp between time t10 and time t15 thus the setup discharge is discouraged from extending to outer scan electrode 280 and outer sustain electrode 220. This reduces the light generated by the falling ramp, which accounts for the second half of the background glow's intensity. Outer scan electrode 280 follows both ramps so as to not affect the setup discharges on inner scan electrode 283.

At time t20, the addressing period begins, and referring to inner scan waveform 915, row drivers 715 switch high, bringing inner scan electrode 283 to the level Vscan. Switch 802 is set to position B during the addressing period, and so, referring to outer scan waveform 920, outer scan electrode 280 is also driven to voltage Vscan. Thus, outer scan electrode 280 is excluded from the addressing discharge.

Between times t20 and t35, each row is individually selected by a low going pulse on its respective scan electrode. For example, with reference to inner scan waveform 915, a low-going pulse starting at time t25 corresponds to a selection of row N, i.e., the row containing sub-pixel 292. If present, the coincidence of an image data-dependent X data pulse on data electrode 210R would trigger an addressing discharge at sustain gap 286. The addressing discharge will form between the data electrode 210R and inner scan electrode 283. The discharge quickly creates a positive column region and a negative glow region. The negative glow will stay at inner scan electrode 283 whereas the positive column will spread across sustain gap 286 enveloping inner sustain electrode 225, thus discharging area 286 within sub-pixel 292.

Also between times t20 and t35, referring to outer sustain waveform 905, outer sustain electrode 220 is driven with an isolation voltage Viso. Referring to inner sustain waveform 910, a voltage Ve is applied to inner sustain electrode 225. Voltage Viso is less than voltage Ve. By placing outer sustain electrode 220 at a lower potential than that of inner sustain electrode 225, the addressing discharge's positive column is discouraged, i.e., suppressed, from spreading across outer sustain electrode 220. By containing the addressing discharge to the smaller area 286 between inner scan electrode 283 and inner sustain electrode 225, rather than permitting the addressing discharge to extend to either or both of outer sustain electrode 220 and outer scan electrode 280, addressing discharge currents are reduced. As the resistive voltage drop across the inner scan electrode 283, and the row driver 715's output resistance limits addressing margin, reducing the addressing discharge current improves the addressing margin.

During time t42 to time t45, a first sustaining discharge occurs with the sustaining discharge current being sourced from the scan electrode pair, i.e. inner scan electrode 283 and outer scan electrode 280U, to the sustain electrode pair i.e., outer sustain electrode 220L and inner sustain electrode 225. Referring to scan generator waveform 925, scan side waveform generator 710 generates a voltage Vs1, which may be greater than the sustain voltage Vs. Scan generator waveform 925 is used to produce both inner scan waveform 915 and outer scan waveform 920, while inner sustain waveform 910 and outer sustain waveform 905 are switched to ground (0V). Voltage Vs1 is chosen so that the positive column region of the discharge spreads across both inner and outer scan electrodes 283 and 280U. Although not shown in FIG. 9, in some embodiments of the invention, particularly where gap 282 is larger than sustain gap 286, a higher voltage is applied to outer scan electrode 280 during the first sustaining discharge so that the sustaining discharge spreads across both inner and outer scan electrodes 283 and 280U, thus discharging the full sub-pixel area 292.

A second, third, and subsequent sustaining discharges occur with sustain and scan side waveform generators 705 and 710 producing sustain pulses of amplitude Vs volts. Synchronously with each sustain pulse edge, switches 801 and 802 connect the corresponding outer electrodes 220 or 280 to apply voltage Vs3. Specifically at time t45, outer sustain waveform 905 applies a voltage Vs3 to outer sustain electrode 220 while inner sustain waveform 910 applies a voltage Vs to the inner sustain electrodes 225. Similarly, at time t60, outer scan waveform 920 applies a voltage Vs3 to outer scan electrode 280 while scan N waveform 915 applies a voltage Vs to the inner scan electrode 283, the inner sustain electrodes are driven to voltage Vs and the outer sustain electrodes are driven to Vs plus Vs3.

Sustaining discharges are intended to extend to outer sustain electrode 220 and outer scan electrode 280, and so, voltages, i.e., Vs3, applied to outer electrodes 220 and 280 are higher than voltages, i.e., Vs, applied to inner electrodes 225 and 283. With higher voltages available to outer electrodes 220 and 280, larger split electrode gaps 290 and 282 may be realized. For example, split electrode gaps 290 and 282 may be 150% the size of sustain gap 286. Such an embodiment increases the size of the positive column region of the discharge, which has been shown to provide higher luminous efficiency. For further elaboration, see U.S. Pat. No. 6,184,848 to Weber.

Figure 10:
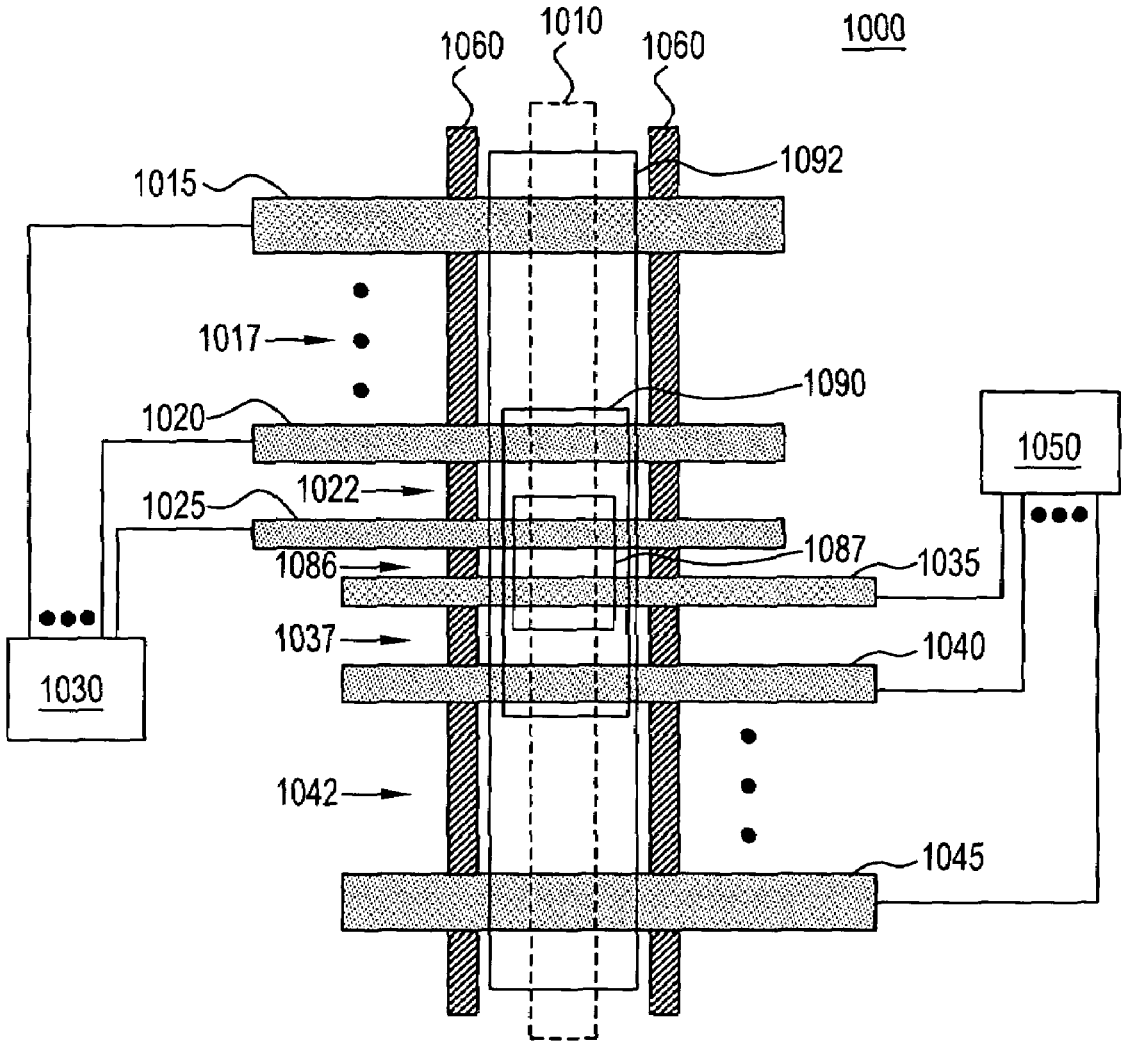
FIG. 10 is a diagram of a pixel configured in accordance with another embodiment of the present invention.

Referring to FIG. 10, another embodiment of the present invention comprises a PDP 1000, of which only a portion is shown. PDP 1000 includes a sub-pixel 1092 that includes a plurality of back plate barrier ribs 1060, a back plate data electrode 1010, three or more front plate sustain electrodes 1015, 1020 and 1025 forming a split sustain electrode, which is driven by a sustain side controller 1030. PDP 1000 also includes three or more front plate scan electrodes 1035, 1040 and 1045 forming a split scan electrode connected to a scan side controller 1050, which is driven by a scan side controller 1050.

Sustain side controller 1030 provides independent control of at least three sustain electrodes 1015, 1020 and 1025. Scan side controller 1050 provides independent control of at least three scan electrodes 1035, 1040 and 1045. Independent control of each electrode provides the ability to control a subset of each split electrode to contain discharges to an inner most sub-pixel area 1087 bounded horizontally by barrier ribs 1060 and vertically by at least one sustain electrode 1020 and at least one scan electrode 1040. Furthermore, independent control allows ascending voltages to be optionally applied to each electrode set (sustain or scan) during a sustain discharge to optionally allow the sustain discharge to discharge beyond the inner most area 1087. PDP 1000 provides increased power and therefore brightness for each sustain discharge, while reducing the power and brightness of setup and addressing discharges.

For a given sustain discharge wherein the entire sub-pixel area is to be discharged, the sustain electrodes are the positively charged anode and the scan electrodes are the negatively charged cathode, separate voltages may be applied to sustain electrodes 1025, 1020 and 1015, such that the voltage applied to sustain electrode 1015, typically 250 Volts, is greater than the voltage applied to sustain electrode 1020, typically 220V, which is greater than the voltage applied to sustain electrode 1025, typically 200V, while the scan electrodes are driven negative relative to the sustain electrodes to a common potential, which typically may be 0 Volt. As the sustain discharge forms, the discharge's positive column region will quickly spread across sustain electrodes 1025, 1020 and 1015, while the negative glow region will drift slowly across scan electrodes 1035, 1040 and 1045. On the next alternating sustain discharge, ascending voltages are applied to scan electrodes 1035, 1040 and 1045 respectively, while sustain electrodes are driven to a common potential of 0 volt.

Subsequent to the given sustain discharge, removing the ascending voltages applied to sustain electrodes 1025, 1020 and 1015 results in an ascending negative voltage across the gas when such electrodes become a cathode for the next alternating sustain discharge. That is, the outer most sustain electrode 1015 becomes the most negative due to the wall charge of the last discharge. This ascending negative voltage aids in the drift of the negative glow across the sustain (now acting as a cathode) electrodes 1025, 1020 and 1015, drawing the negative glow outward without requiring that additional voltages be applied to each cathode electrode.

The ability to control voltages independently allows reduced areas 1087 and 1090 to be discharged compared to the full sub-pixel area 1092. Such an embodiment of the invention allows for controllable discharge areas. It is desirable to make sustain gap 1086 between inner sustain electrode 1025 and inner scan electrode 1035 small, typically 50 to 100 microns to reduce the firing voltage of the gas. It is also desirable to make a gap 1022 between split electrodes 1020 and 1025 and a gap 1017 between split electrodes 1015 and 1020 larger, for example, 100 to 200 microns to improve the luminous efficiency of the display. Similarly, a gap 1037 between split electrodes 1035 is smaller than a gap 1042 between split electrodes 1040 and 1045.

FIG. 10 also shows varied electrode widths among the electrodes within each split electrode. It is typically desirable to minimize the widths of opaque metallic electrodes within the discharge area, to reduce the amount of light blocked by the conductor. Additionally, the narrow innermost electrodes reduce the power and brightness of setup and addressing discharges. The power applied during the sustain discharges is proportional to the electrode area, therefore wider middle and outer electrodes provide greater discharge power and therefore brightness. A compromise must be made with regard to the opaque conductor width to maximize luminous efficiency. Since less light is produced at the extremity of the discharge cell, the outermost electrode may be the widest.

As plasma displays increase in size, it is desirable to increase the size of the pixel. FIG. 10 may be expanded to include additional middle sustain electrodes 1020 in the space 1017, and including an additional matching scan electrodes in the space 1042. In this case, additional driving circuits may be added to sustain controller 1030 and scan controller 1050. Independent control of each electrode allows sufficient voltage to be applied to each electrode to allow the discharge to spread across each split electrode set. Also, independent control allows the discharge to be contained to an additional area within the sub-pixel area. For example, the additional area could be contained within sub-pixel area 1092 with area 1090 contained within the additional area and an additional sustain electrode and an additional scan electrode positioned within gaps 1017 and 1042, respectively.

Figure 13:
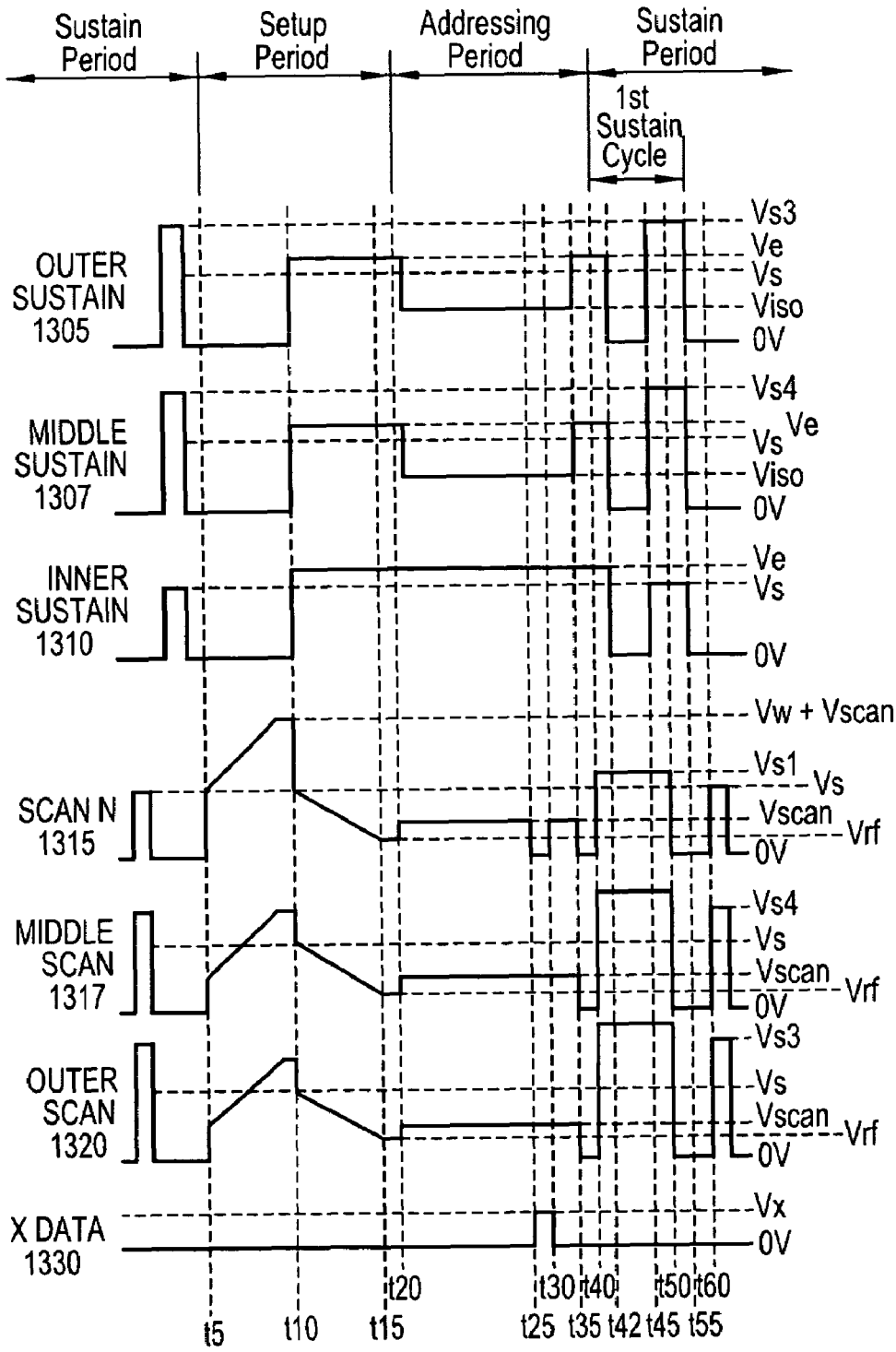
FIG. 13 is a waveform drawing of the waveforms applied to each of the electrodes of FIG. 11
Figure 16:
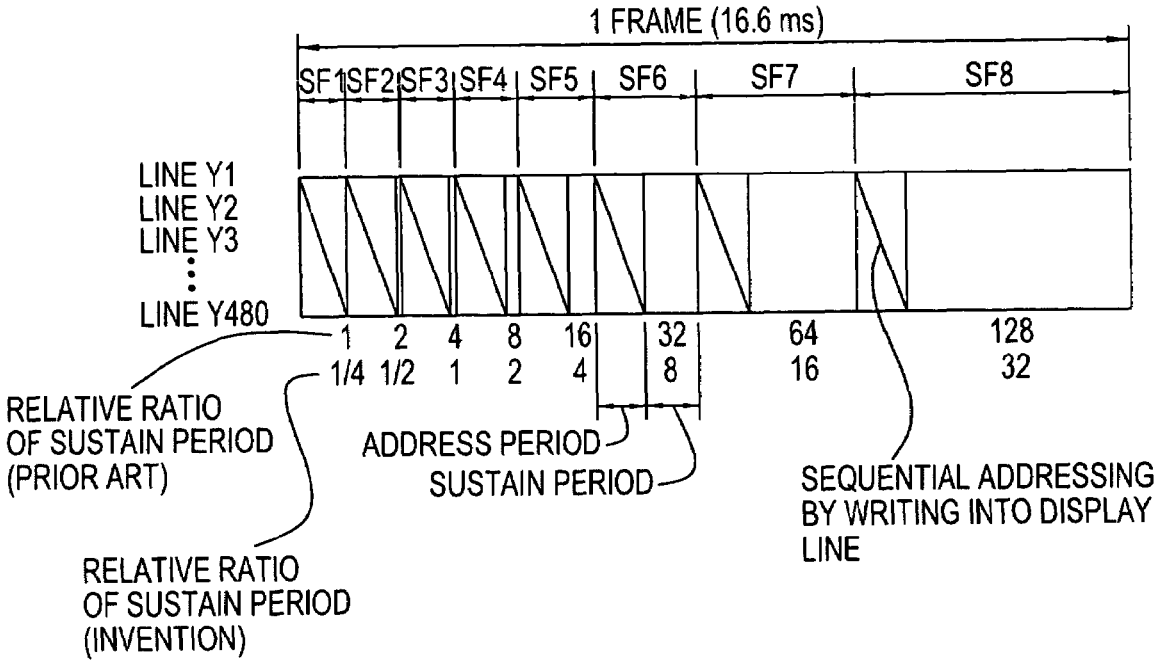
FIG. 16 is a frame timing diagram of a typical 8 sub-field PDP addressing implementation.

For a configuration of four or more split electrodes as shown in FIG. 16, the pixel may be extended in size by adding additional scan and sustain electrodes in pairs, and applying the ascending voltage scheme as demonstrated in FIG. 13. In such an embodiment of the invention, it is contemplated that applying additional negative voltages to the sustain electrodes during the first sustain discharge could be beneficial to further draw the negative glow across the split sustain electrode set.

Figure 11:
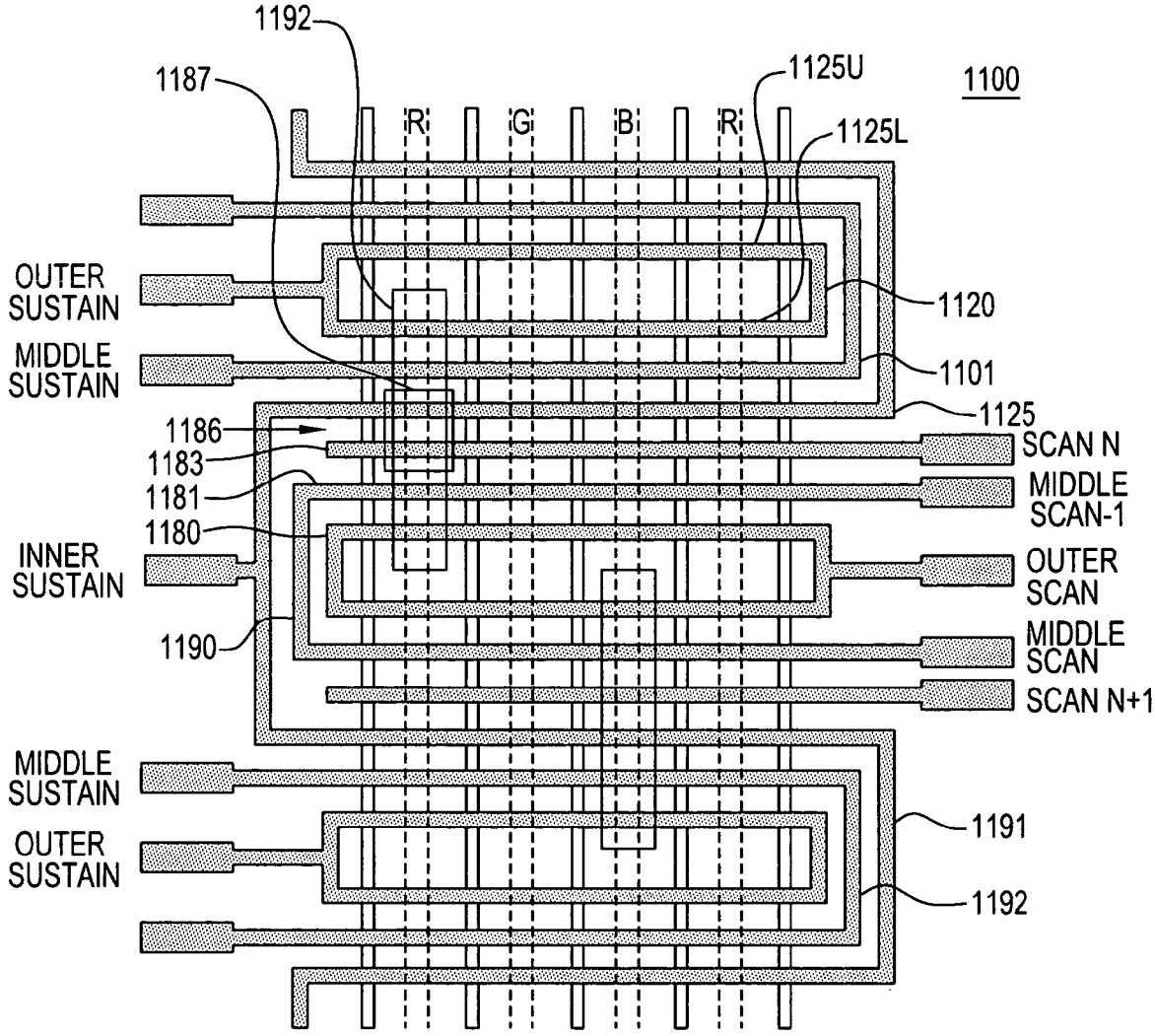
FIG. 11 is a diagram of a portion of another embodiment of a PDP configured with split electrodes.

Referring to FIG. 11, another embodiment of the present invention comprises a PDP 1100, of which only a portion is shown. PDP 1100 generally comprises three split electrodes (sustain and scan) as compared to the two split electrodes of PDP 200 (FIG. 2). PDP 1100 comprises a middle sustain electrode 1101 placed between an inner sustain electrode 1125 and an outer sustain electrode loop 1120. Similarly, a middle scan electrode 1181 is placed between an inner scan row N electrode 1183 and an outer scan electrode loop 1180.

When photolithographic processes are employed to manufacture the electrodes of FIG. 11, it is possible to have small breaks in the electrodes forming an electrical open circuit. To provide a redundant current path in the event of an electrode open circuit within the display area, middle scan electrodes may be connected on the sustain side by shorting electrode 1190 similar to outer sustain electrode 1120 and outer scan electrode 1180 constructed as loop electrodes. Similarly, inner sustain electrodes may be connected by shorting electrode 1191 and middle sustain electrodes may be connected by shorting electrode 1192.

Referring to FIG. 13, the waveforms applied to the three electrode PDP 1100 of FIG. 11 are those of FIG. 9 with minor changes to the sustain period. FIG. 13 corresponds with FIG. 11 such that outer sustain electrode 1120 is driven with outer sustain waveform 1305, middle sustain electrode 1101 is driven with middle sustain waveform 1307 etc.

For the first sustain discharge, which occurs between times t42 and t45, sustain electrodes 1101, 1120 and 1125 are driven to a common potential of 0 volts, while ascending voltages are applied to each of the scan electrodes. Scan N electrode 1183 is driven to a voltage Vs1, middle scan electrode 1181 is driven to a voltage Vs4, and outer scan electrode 1180 is driven to a voltage Vs3, where Vs3 is greater than Vs4, which is greater than Vs1. Vs1 may be at or above voltage Vs as required to improve operating margin. With ascending voltages applied to the split scan electrode set 1183, 1181 and 1180 respectively, the positive column of the first sustain discharge will spread from a sustain gap 1186 across the split scan electrode set discharging the lower half of an area 1192. With equal voltages applied to sustain electrodes 1101, 1120 and 1125, the negative glow may or may not fully spread across the split sustain electrode set.

For the second sustain discharge, ascending voltages are applied to the split sustain electrode set 1125, 1101 and 1120 respectively, while the split scan electrode set 1183 1181 and 1180 is returned to 0V. While the voltages applied to each scan electrode are equal, the wall charge on the dielectric surface from the previous discharge in combination with the drop in voltage applied to the electrode, results in an ascending negative voltage across the split scan electrode set. Thus, the second sustain discharge yields a positive column spreading across the split sustain electrode set, while the negative glow spreads across the split scan electrode set, and the entire cell area 1192 is discharged.

Similarly, subsequent sustain discharges occur wherein the ascending voltages are alternately applied to the scan and sustain electrode sets while scan and sustain electrodes are driven to 0V respectively.

Figure 12:
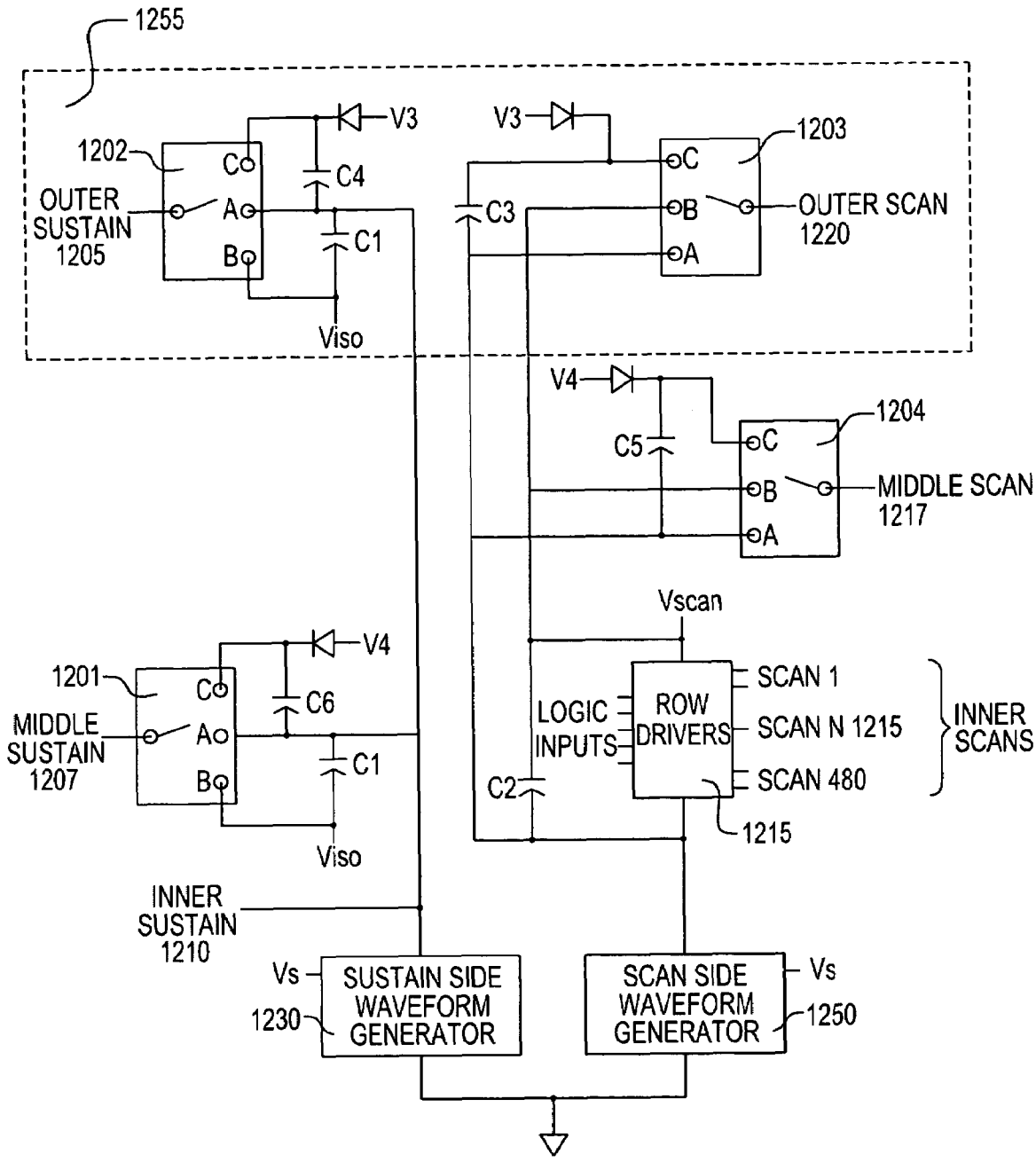
FIG. 12 is a block diagram of the circuitry used to drive the PDP of FIG. 11.

Referring to FIG. 12, relative to FIG. 8 switch circuits 801 and 802 are replicated as switch pair 1255 supplied by a voltage V3 where V3 is greater than V4 to create an additional ascending voltage level necessary to drive the third and outer most sustain and scan electrodes 1205 and 1220 respectively which correspond to outer sustain electrode 1120 and outer scan electrode 1180. Capacitors C5 and C6 create floating versions of V4, and capacitors C3 and C4 create floating versions of V3. Thus, when the sustain or scan generator outputs Vs to the inner scan or sustain electrodes 1183 and 1125, Vs4 equal to Vs+V4 may be applied to the middle scan or sustain electrodes 1181 and 1101, and Vs3 equal to Vs+V3 may be applied to the outer scan or sustain electrodes 1180 and 1120. Similarly, voltages Vscan and Viso float on output of the scan and sustain waveform generators respectively.

As in PDP 200 (FIG. 2) with the waveforms of FIG. 9, an inner electrode area 1187 of PDP 1100 of FIG. 11 is discharged for setup and addressing operations, while the outer areas above and below area 1187 in sub-pixel 1192 are discharged for sustain operations. Operation of switch 1204 is the same as that of switch 802 and is operated in tandem with switch 1203 so that during the setup and addressing periods the middle and outer scan electrodes are driven through terminal B to isolate discharge activity to area 1087 occurring on inner scan electrode 1183 from the middle and outer scan electrodes 1181 and 1180. During the sustain period, switch 1203 and 1204 toggle between terminals A and C so that when the scan side waveform generator produces a sustain pulse of voltage Vs, switches 1203 and 1204 select terminal C.

Similarly, Switch 1202 is operated in tandem with Switch 1201 so that during the setup period terminal A is selected to operate the middle and outer sustain electrodes 1101 and 1120 with the inner sustain electrode 1125 and during the addressing period, the middle and outer sustain electrodes 1101 and 1120 are connected through terminal B to the isolation voltage, Viso so that addressing discharges involving the inner sustain electrodes do not extend to the middle and outer sustain electrodes. During the sustain period, switches 1202 and 1205 toggle between terminals A and C so that when the sustain side waveform generator produces a sustain pulse of voltage Vs, switches 1202 and 1201 select terminal C. The total voltage applied to the outer sustain and middle sustain electrodes is Vs3 and Vs4, respectively.

For embodiments including four or more split electrodes, additional switch circuit pairs 1255 may be added, each circuit requiring a voltage greater than V3.

Figure 14:
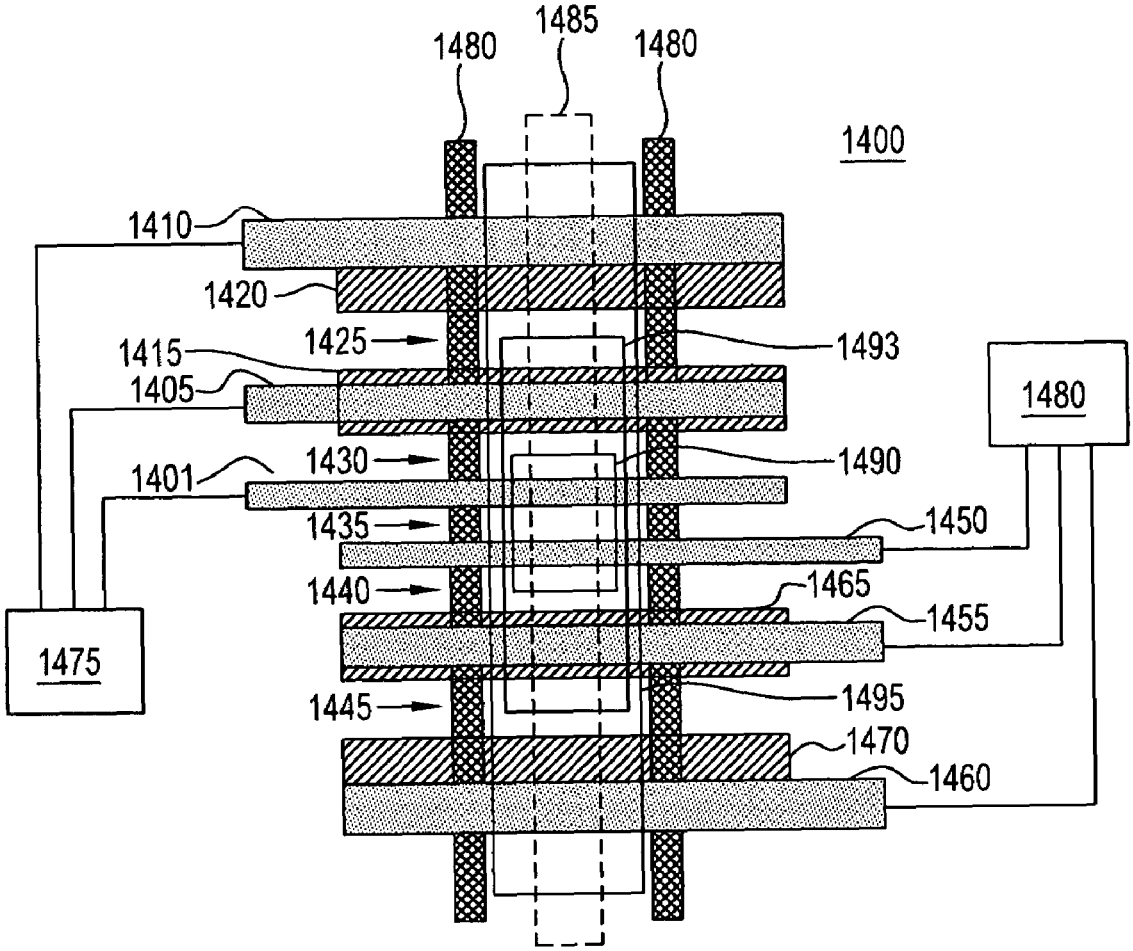
FIG. 14 is a diagram of a portion of another embodiment of a PDP configured with split electrodes.

Referring to FIG. 14, another embodiment of the present invention comprises a PDP 1400 with electrodes that have varying electrode widths and varied electrode spacing. Specifically, from the center of the pixel a sustain gap 1435, an electrode 1401 exhibits a width, which that is narrower than that of an electrode 1405, which is narrower than electrode 1410. The respective electrodes 1450, 1455, and 1460 also exhibit the same width variation. Additionally, electrodes 1405, 1410, 1455, 1460, each have a transparent electrode portion 1415, 1420, 1465, and 1470, respectively. Electrode gap or space 1435 is smaller than an electrode space 1430, which is less than an electrode space 1425.

Respective electrode spaces 1440 and 1445 also exhibit the same electrode spacing as spaces 1430 and 1425, respectively. Electrodes 1401, 1405 and 1410 are connected to a waveform generator 1475 while electrodes 1450, 1455 and 1460 are connected to waveform generator 1480.

Each waveform generator 1475 and 1480 controls its respective electrodes such that setup and addressing operations are performed about sustain gap 1435, affecting wall charges in a center pixel area 1490. During a sustain period, independent control of the voltages allows the sustain discharge to be controlled to the center of pixel area 1490, or the discharge may be extended to a middle pixel area 1493, or to a full pixel area 1495. The sustain discharge area is controlled by each waveform generator 1475 and 1480 by the voltages applied to each of its electrodes. Each waveform generator 1475 and 1480 in turn applies voltages to its respective electrodes to create discharges alternating in opposite directions. For each voltage application, the waveform generates successively increasing voltages to its respective electrodes to expand the discharge area, and conversely successively decreasing voltages to contain the discharge within a region.

Referring to FIG. 14, in a preferred embodiment, the inner scan and inner sustain electrodes have widths narrower than that of the middle or outer electrodes. Scan electrode widths should be matched with an equal width sustain electrode counter part. That is, a narrow, typically 40-80 micron wide inner scan electrode should be matched with an equal width inner sustain electrode. Narrow inner electrodes reduce the power and, therefore, brightness of the background light produced by setup discharges. Narrow inner electrodes also minimize the amount of light blocked by opaque metallic conductors. The middle and outer electrodes may be fabricated with wider electrodes either of the transparent type 1420 with metallic bus electrodes 1410, or with apertured electrodes as in U.S. Pat. No. 6,411,035 to Marcotte. Wider middle and outer transparent electrodes, typically 100 to 250 microns allow for large pixel areas, high power levels and therefore high brightness to be achieved. The width of the bus electrodes 1410, 1405, 1455, 1460 is minimized and chosen to meet electrode resistance and manufacturability requirements while blocking as little light as possible.

The waveforms shown in FIGS. 3 and 9, and the circuits of FIGS. 7 and 8 are described herein as being used with the PDP of FIG. 2. However, the concepts of FIGS. 3 and 9, and 7 and 8 are also applicable to the PDPs of FIGS. 1, 4-6, 10 and 11.

In another embodiment of the invention, PDP 1400 can be operated to provide controllable brightness. The power and brightness of low order sub-fields can be reduced by limiting the pixel area discharged with each sustain pulse within a sustain period of a sub-field. For low brightness sub-fields, an inner pixel area is sustained, while for high brightness sub-fields, the entire pixel area may be discharged. The number of split electrodes determines the number of brightness levels obtainable, while the individual electrode widths and spaces determine the brightness of each level.

Figure 15:
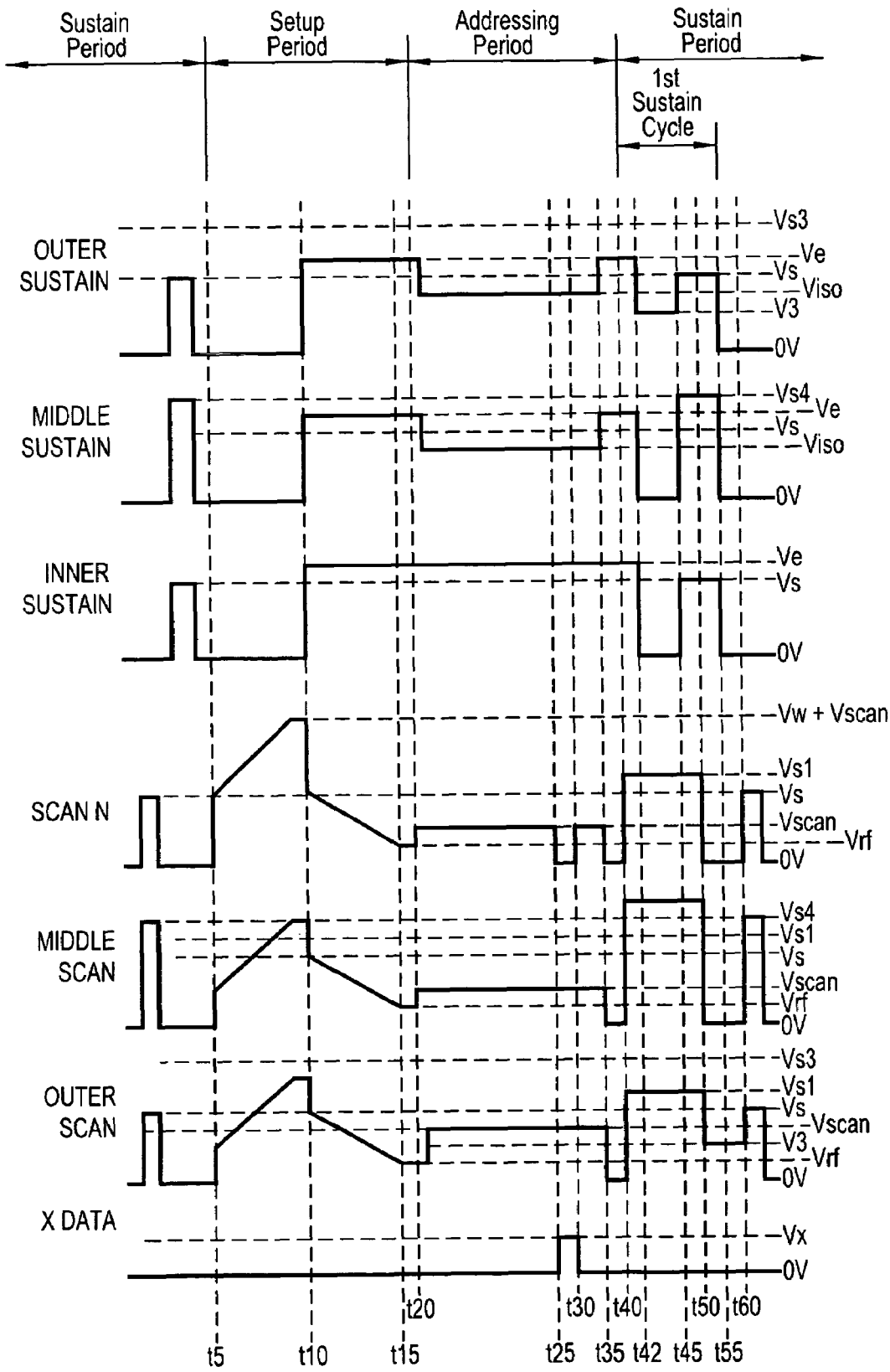
FIG. 15 is a waveform drawing of the waveforms applied to each of the electrodes of FIG. 14.

Referring to FIG. 15, there is provided a set of waveforms for operating PDP 1400 with the circuitry of FIG. 12 to contain the sustain discharges to the region 1493. This method of operation is desirable to reduce the light output when sustain discharges of low intensity are required. Since ascending voltages are required to cause the discharge to spread across the split electrode set, the omission of such ascending voltages will not allow the discharge to spread: Consequently, during the first sustain discharge t42-t45, the outer scan electrode switch 1203, selects terminal A, the output of the scan generator. Concurrently, switch 1204 selects terminal C, the floating voltage V4, while the output of the sustain generator is at 0 volts. As a result, the voltage required for the positive column portion of the discharge to spread, Vs3, is not applied, so the positive column will be contained to the split scan electrode area of 1493. Similarly, the negative glow portion of the discharge requires the application of a negative voltage on the outer sustain electrode 1410 relative to the middle sustain electrode 1405 for the negative glow to spread. With switch 1202 applying voltage V3, during t42-t45, there is insufficient voltage for the negative glow to spread beyond the middle sustain electrode 1405 of area 1493. With the second and subsequent discharges, each outer electrode applies voltage Vs in the high state, and voltage V3 in the low state, and the discharges are contained within area 1493.

The same methodology may be applied to additional middle scan and sustain electrode pairs, to provide brightness control based upon a variable discharge area.

FIG. 16 shows the frame timing of a very generic 8 sub-field PDP addressing implementation. Recent PDP displays use more sub-fields and different weightings to achieve 256 or more gray levels. To achieve 256 gray levels at a given pixel site, one or more sub-fields are addressed to activate the desired sustain periods. For example, to achieve a brightness at a pixel at gray level 20, the pixel needs to be addressed and sustained in sub-fields SF3 and SF5. SF3 produces a relative ratio of the sustain period of 4 and SF5 produces a relative ratio of the sustain period of 16. The summation therefore makes 20. As shown, each sustain period is weighted by powers of 2 so that the summation of all 8 sub-fields is 256 levels.

Individual sub-field brightness has traditionally only been performed by controlling the number of sustain pulses. As PDP's have improved, the brightness per discharge has increased and this trend will continue into the future. As the brightness per discharge increases, the number of sustain discharges required for a given brightness will decrease. Also, power reduction schemes involve limiting the number of sustain pulses to reduce power dissipation. These conditions can result in the low order sub-field requiring a brightness of less than one sustain cycle. Therefore, a new method is required to control the brightness of a single discharge.

With the PDP of FIG. 14, and the methodology of FIG. 15 both of these conditions can be accommodated. For example if the total brightness is to be divided by 4, then the weighting of each sub-field must be divided by 4. Hence, SF8's relative ratio of the sustain period would be reduced from 128 to 32. The relative brightness of SF1 must be 1/128 of the brightness of SF8, requiring a relative ration of 1/4, SF2 would be 1/2 and SF3 would be 1. If the per discharge brightness of the PDP is such that a single sustain cycle comprising 2 discharges, produces more light than is required, then a fractional area may be employed to produced the lower light requirement.

To achieve these fractional relative ratio's, the areas 1490, 1493 and 1495 must be operated such that the brightness of area 1490 is half of the brightness of area 1493, which is half the brightness of area 1495. Two methods are available to meet this requirement. Firstly, the areas may be chosen, giving consideration to the fact that greater light is produced in the center area of a pixel, than at the extremes. Therefore, area 1493 will be greater than 2× area 1490. Likewise, area 1495 will need to be greater than 2× the area 1493. Secondly, in selecting the voltages to be applied to the middle and outer electrodes sets, higher voltages will produce more light, and so increased light may be produced at the outer areas by increasing voltages Vs3 and Vs4 to apply more power to the extremities.

It should be understood that various alternatives and modifications of the present invention could be devised by those skilled in the art. Nevertheless, the present invention is intended to embrace all such alternatives, modifications and variances that fall within the scope of the appended claims.

What is claimed is:

1. A method of controlling a discharge in a pixel comprising:

providing an electrode topology that is disposed with respect to said pixel to define a first area and a second area of said pixel, wherein said first area is larger than said second area; and controlling said discharge by selectively causing said discharge to occur in said first and second areas wherein said controlling comprises:

applying a first voltage waveform to an outer sustain electrode of said electrode topology;

applying a second voltage waveform to a middle sustain electrode of said electrode topology;

applying a third voltage waveform to an inner sustain electrode of said electrode topology;

applying a fourth voltage waveform to an inner scan electrode of said electrode topology;

applying a fifth voltage waveform to a middle scan electrode of said electrode topology; and applying a sixth voltage waveform to an outer scan electrode of said electrode topology, wherein said first, second, third, fourth, fifth and sixth voltage waveforms have relationships that (i) discourage an addressing discharge involving said inner sustain electrode and said inner scan electrode from extending to said middle and outer sustain electrodes and to said middle and outer scan electrodes, and (ii) permit a sustaining discharge involving said inner sustain electrode and said inner scan electrode to extend to said middle and outer sustain electrodes and said middle and outer scan electrodes.

2. The method of claim 1, further comprising: additionally controlling said sustaining discharge by modulating at least one of said voltage waveforms in amplitude and/or duration.

3. The method of claim 1, wherein said second area is centered in said first area.

4. The method of claim 1, wherein a first sustain period of a first sub-field discharges said second area and a second sustain period of a second sub-field discharges said first area.

5. The method of claim 1, wherein said controlling controls a brightness of said pixel.

6. The method of claim 1, wherein during a set up period and an addressing period said second and third waveforms are substantially identical.

7. The method of claim 1, wherein said first, second and third voltage waveforms are applied independently of one another.

8. A plasma display panel, comprising:

a pixel;

an electrode topology that is disposed with respect to said pixel to define a first area and a second area of said pixel, wherein said first area is larger than said second area; and a controller that applies voltages to said electrode topology to control a discharge of said pixel by selectively causing said discharge to occur in said first and second areas, wherein said electrode topology comprises an outer sustain electrode, a middle sustain electrode, an inner sustain electrode, an inner scan electrode, a middle scan electrode and an outer scan electrode, wherein said controller applies first, second, third, fourth, fifth and sixth voltages to said outer sustain, said middle sustain, said inner sustain, said inner scan, said middle scan and said outer scan electrodes, respectively, wherein during a first cycle of a sustain period, a magnitude of said fifth voltage is greater than a magnitude of said fourth voltage and a magnitude of said sixth voltage, and wherein said first, second and third voltages each have a magnitude that is less than said magnitudes of said fourth and sixth voltages.

9. The plasma display panel of claim 8, wherein said controller additionally controls said discharge by modulating at least one of said voltages in amplitude and/or duration.

10. The plasma display panel of claim 8, wherein said second area is centered in said first area.

11. The plasma display panel of claim 8, wherein said discharge is selected from the group consisting of: setup discharge, address discharge and sustain discharge.

12. The plasma display panel of claim 8, wherein said voltages modulate said discharge, thereby controlling a brightness of said pixel.

13. The plasma display panel of claim 12, wherein in a first sustain period of a first sub-field said discharge occurs in said second area, and in a second sustain period of a second sub-field said discharge occurs in said first area.

14. The plasma display panel of claim 8, wherein said discharge of said pixel is limited to said second area.

15. The plasma display panel of claim 8, wherein said electrode topology further defines a third area of said pixel that is within said first area, wherein said second area is within said third area, and wherein said voltages initiate a discharge during a sustain period that spreads to said third area, but not to other regions of said first area, thereby confining a light output to said second and third areas of said pixel.

16. The plasma display panel of claim 8, wherein during a second cycle of said sustain period, a magnitude of said second voltage is greater than a magnitude of said first voltage and a magnitude of said third voltage, and wherein said fourth, fifth and sixth voltages each have a magnitude that is less than said magnitudes of said first and third voltages.

17. The plasma display panel of claim 8, wherein said first, second, third, fourth, fifth and sixth voltages are components of first, second, third, fourth, fifth and sixth voltage waveforms, respectively, that have a relationship that (i) discourages an addressing discharge involving said inner sustain electrode and said inner scan electrode from extending to said middle and outer sustain electrodes and to said middle and outer scan electrodes, and (ii) permits a sustaining discharge involving said inner sustain electrode and said inner scan electrode to extend to said middle and outer sustain electrodes and said middle and outer scan electrodes.

18. The plasma display panel of claim 8, wherein said inner scan electrode and said inner sustain electrode are separated by a first gap, wherein said inner sustain electrode and said middle sustain electrode are separated by a second gap, wherein said inner scan electrode and said middle scan electrode are separated by a third gap, and wherein said first gap is smaller than said either said second gap or said third gap.

19. The plasma display panel of claim 8, wherein said inner sustain electrode is narrower than said middle sustain electrode and said middle sustain electrode is narrower than said outer sustain electrode, and wherein said inner scan electrode is narrower than said middle scan electrode and said middle scan electrode is narrower than said outer scan electrode.

20. A plasma display panel, comprising:

a pixel;

a split electrode configured with an outer sustain electrode and a middle sustain electrode arranged to control plasma gas discharge at said pixel;

an inner sustain electrode;

an inner scan electrode;

a middle scan electrode;

an outer scan electrode;

a controller that applies a first voltage waveform to said outer sustain electrode, a second voltage waveform to said middle sustain electrode, a third voltage waveform to said inner sustain electrode, a fourth voltage waveform to said inner scan electrode, a fifth voltage waveform to said middle scan electrode, and a sixth voltage waveform to said outer scan electrode, independently of one another, wherein said first, second, third, fourth, fifth and sixth voltage waveforms have relationships that (i) discourage an addressing discharge involving said inner sustain electrode and said inner scan electrode from extending to said middle sustain electrode and outer sustain electrode and to said middle scan electrode and said outer scan electrode, and (ii) permit a sustaining discharge involving said inner sustain electrode and said inner scan electrode to extend to said middle sustain electrode and said outer sustain electrode and to said middle scan electrode and said outer scan electrode.

21. The plasma display panel of claim 20, wherein said inner scan electrode and said inner sustain electrode are separated by a first gap, wherein said inner sustain electrode and said middle sustain electrode are separated by a second gap, wherein said inner scan electrode and said middle scan electrode are separated by a third gap, and wherein said first gap is smaller than said either said second gap or said third gap.

22. The plasma display panel of claim 20, wherein said inner scan electrode and said inner sustain electrode are narrower than said middle and outer scan electrodes and said middle and outer sustain electrodes.

23. The plasma display panel of claim 22, wherein said middle scan and middle sustain electrodes are narrower than said outer scan and outer sustain electrodes.

24. The plasma display panel of claim 23, wherein said inner scan and inner sustain electrodes are substantially equal in width.

25. The plasma display panel of claim 24, wherein said middle scan and middle sustain electrodes are substantially equal in width, and wherein said outer scan and sustain electrodes are substantially equal in width.

26. The plasma display panel of claim 22, wherein a first gap separates said inner scan and sustain electrodes, a second gap separates said inner and middle scan electrodes and a third gap separates said inner and middle sustain electrodes, and wherein said first gap is narrower than said second and third gaps.

27. The plasma display panel of claim 26, wherein a fourth gap separates said middle and outer scan electrodes and a fifth gap separates said middle and outer sustain electrodes, and wherein said second and third gaps are narrower than said fourth and fifth gaps.

28. The plasma display panel of claim 27, wherein said second and third gaps are substantially equal and said fourth and fifth gaps are substantially equal.

29. The plasma display panel of claim 20, wherein one or more of said outer sustain electrode, said middle sustain electrode, said inner sustain electrode, said inner scan electrode, said middle scan electrode and said outer scan electrode have a transparent electrode portion.

* * * * *